US009886807B2

(12) United States Patent
Takami

(10) Patent No.: US 9,886,807 B2
(45) Date of Patent: Feb. 6, 2018

(54) MONEY HANDLING APPARATUS AND MONEY HANDLING METHOD

(71) Applicant: GLORY LTD., Himeji-shi, Hyogo (JP)

(72) Inventor: Yositaka Takami, Himeji (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

(21) Appl. No.: 15/354,032

(22) Filed: Nov. 17, 2016

(65) Prior Publication Data

US 2017/0140597 A1 May 18, 2017

(30) Foreign Application Priority Data

Nov. 18, 2015 (JP) ..... 2015-225508

(51) Int. Cl.

| | |
|---|---|
| ***G07D 1/00*** | (2006.01) |
| ***G07D 1/02*** | (2006.01) |
| ***G07D 9/00*** | (2006.01) |
| ***G07D 11/00*** | (2006.01) |

(52) U.S. Cl.

CPC ..... *G07D 1/02* (2013.01); *G07D 9/004* (2013.01); *G07D 11/0006* (2013.01); *G07D 11/0057* (2013.01); *G07D 11/0066* (2013.01)

(58) Field of Classification Search

CPC ..... G07D 1/02; G07D 9/004; G07D 11/006; G07D 13/00; G07F 19/00; G06Q 40/00

See application file for complete search history.

(56) References Cited

U.S. PATENT DOCUMENTS

| | | | |
|---|---|---|---|
| 2014/0040085 A1 | 2/2014 | Angus | |
| 2014/0060997 A1 | 3/2014 | Doi et al. | |

FOREIGN PATENT DOCUMENTS

| | | | |
|---|---|---|---|
| EP | 2 555 172 A1 | 2/2013 | |
| EP | 2 680 A1 * | 1/2014 | ..... G06Q 40/00 |
| JP | 2005-38062 A | 2/2005 | |

OTHER PUBLICATIONS

European Search Report (Application No. 16199108.8) (7 pages—dated Dec. 4, 2017).

* cited by examiner

*Primary Examiner* — Mark Beauchaine

(74) *Attorney, Agent, or Firm* — Renner, Kenner, Greive, Bobak, Taylor & Weber

(57) ABSTRACT

A money handling apparatus (for example, a money depositing and dispensing machine (100)) includes a reading unit (129) that reads change machine information that is information stored in a recording medium (304) about a money change machine (200) provided separately from the money handling apparatus; a dispensing unit that dispenses money; and a controlling unit (102) that controls the dispensing unit to cause the dispensing unit to dispense money that is to be replenished in the money change machine (200) based on the change machine information read by the reading unit (129).

7 Claims, 14 Drawing Sheets

MONEY HANDLING APPARATUS AND MONEY HANDLING METHOD

CROSS-REFERENCE TO THE RELATED APPLICATION

This application is based upon and claims the benefit of priority from the prior Japanese Patent Application No. 2015-225508 filed on Nov. 18, 2015, the entire contents of which are incorporated herein by reference.

BACKGROUND OF THE INVENTION

1. Field of the Invention

The present invention relates to a money handling apparatus such as a teller machine that performs at least a money dispensing processing, and a money handling method implemented on such a money handling apparatus.

2. Description of the Related Art

In a shop, such as a supermarket and a convenience store, a money change machine is installed at the check-out counter in the front area in which the store shelves are installed, and a money depositing and dispensing machine such as a teller machine is installed in the backyard area in which entry of the customer is prohibited. The money change machine installed at the check-out counter in the front area has a function to perform a money depositing process of receiving money handed by a customer to a salesclerk in exchange of goods, and to perform a money dispensing process of dispensing money as change. On the other hand, the money depositing and dispensing machine, such as a teller machine, installed in the backyard area has a function to perform a money depositing process of receiving money as the sales proceeds collected from the money change machine, and to perform a money dispensing process of dispensing money as change replenishment money which is to be replenished in the money change machine.

Moreover, Japanese Patent Application Laid-Open No. 2005-38062 (JP2005-38062A) discloses a conventional cash management apparatus that manages sales proceeds and the like stored in a money change machine. The cash management apparatus disclosed in JP2005-38062A includes a cash inlet for inserting cash, a change cabinet for storing therein cash as change, and a cash safe for storing therein sales proceeds. Moreover, a storage reference amount of money to be stored for each denomination in the change cabinet is set previously. When the money collected from the money change machine is deposited in the cash inlet of the cash management apparatus, the money equal to the storage reference amount is stored for each denomination in the change cabinet, and the money that exceeds the storage reference amount is stored in the cash safe. With this operation, the money as the change is recycled.

SUMMARY OF THE INVENTION

However, when using the conventional cash management apparatus disclosed in JP2005-38062A and the like, when replenishing money as change in the money change machine, the salesclerk must calculate a breakdown (specifically, number and the like of money to be replenished for each denomination) of the money for the replenishing based on an inventory amount in the money change machine, note down the calculation result on a slip and the like, and manually input the figures in the cash management apparatus. Because it requires much time in performing this task, the workload on the salesclerk increases, and, there are fears of occurrence of input error.

The present invention was made in view of the above discussion. It is an object of the present invention to provide a money handling apparatus and a money handling method that eliminate an operation by a salesclerk of manually inputting a breakdown of money that is to be replenished in a money change machine thereby reducing the workload on the salesclerk and preventing an input error.

A money handling apparatus of the present invention is a money handling apparatus that performs at least a money dispensing processing, including: a reading unit that reads change machine information that is information stored in a recording medium about a money change machine provided separately from the money handling apparatus; a dispensing unit that dispenses money; and a controlling unit that controls the dispensing unit to cause the dispensing unit to dispense money that is to be replenished in the money change machine based on the change machine information read by the reading unit.

In the money handling apparatus of the present invention, the change machine information may be an inventory amount of the money change machine including an inventory amount of a roll of coins.

In this case, the money handling apparatus of the present invention may further include a memory that stores therein a remaining setting number for each denomination of money in the money change machine, and number of money for each denomination that is to be dispensed by the dispensing unit is calculated by subtracting number of money for each denomination concerning the inventory amount of the money change machine read by the reading unit from the remaining setting number for each denomination of money stored in the memory.

The money handling apparatus of the present invention may further include: a coin-roll storing assembly that stores therein a roll of coins; a locking mechanism that locks the coin-roll storing assembly inside a housing, and the controlling unit controls the locking mechanism to release the lock of the coin-roll storing assembly if a roll of coins is included in the money that is to be dispensed by the dispensing unit.

In the money handling apparatus of the present invention, a storing cassette that stores therein money and that feeds out money stored therein may be detachably attached to the money handling apparatus, the storing medium may be arranged in the storing cassette, and the reading unit may read the information stored in the recording medium arranged on the storing cassette when the storing cassette is attached to the money handling apparatus.

In this case, the dispensing unit may dispense money into the storing cassette that has been attached to the money handling apparatus.

The money handling apparatus of the present invention may further include a money dispensing outlet for ejecting money from inside to outside of the housing, and the dispensing unit may dispense money to the outside of the housing through the money dispensing outlet.

The money handling apparatus of the present invention may further include a writing unit that writes information in the recording medium, and the controlling unit may control the writing unit to cause the writing unit to write in the recording medium information concerning number of money for each denomination that could not be dispensed by the dispensing unit when an abnormality occurs while the dispensing unit is dispensing money.

A money handling method of the present invention is a money handling method that is implemented on a money handling apparatus that performs at least a money dispensing processing, including: reading change machine information that is information stored in a recording medium about a money change machine provided separately from the money handling apparatus by a reading unit; and dispensing money that is to be replenished in the money change machine based on the change machine information read by the reading unit.

DETAILED DESCRIPTION OF THE INVENTION

Figure 1:
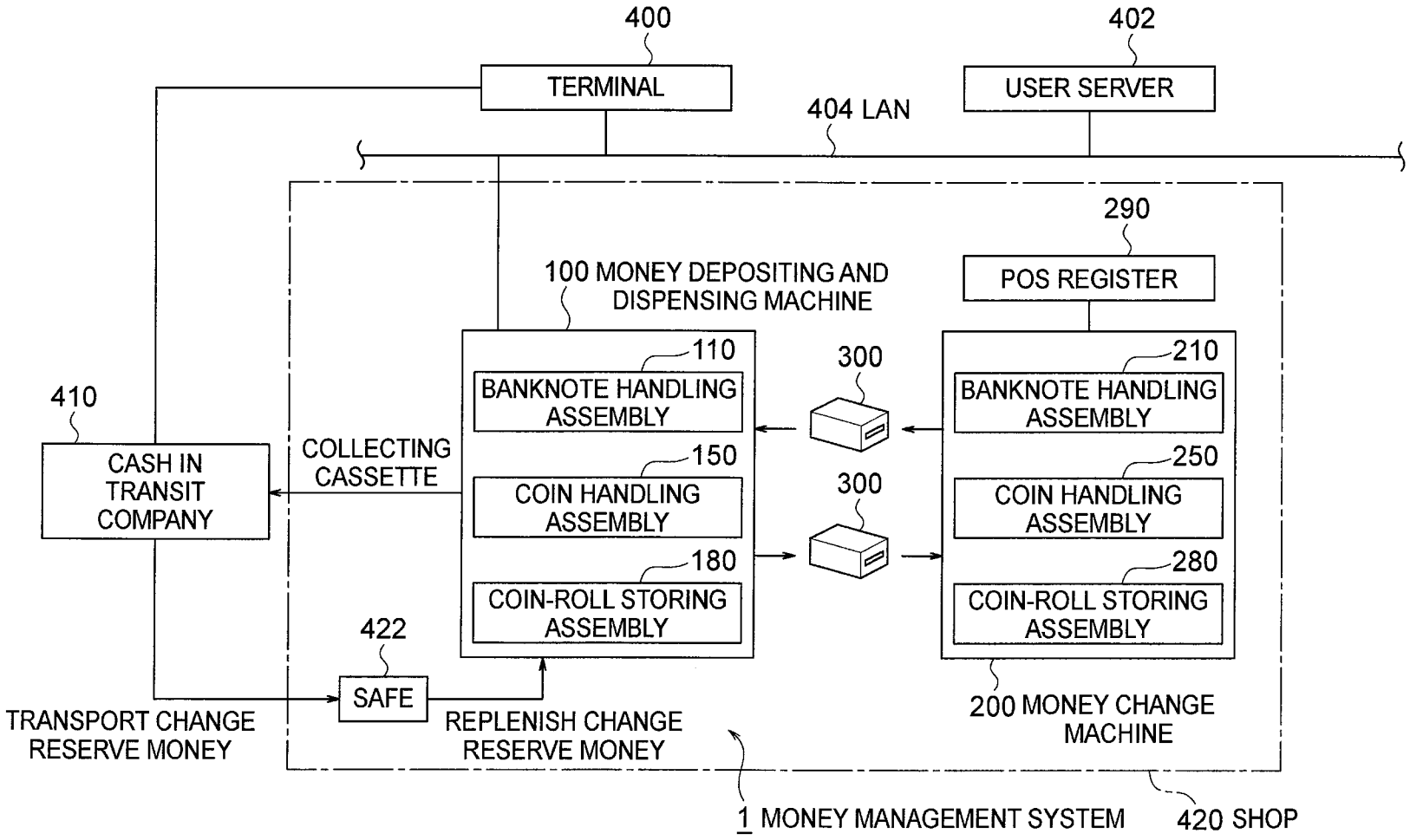
FIG. 1 is a schematic diagram for explaining a configuration of a money management system according to an embodiment of the present invention.
Figure 2:
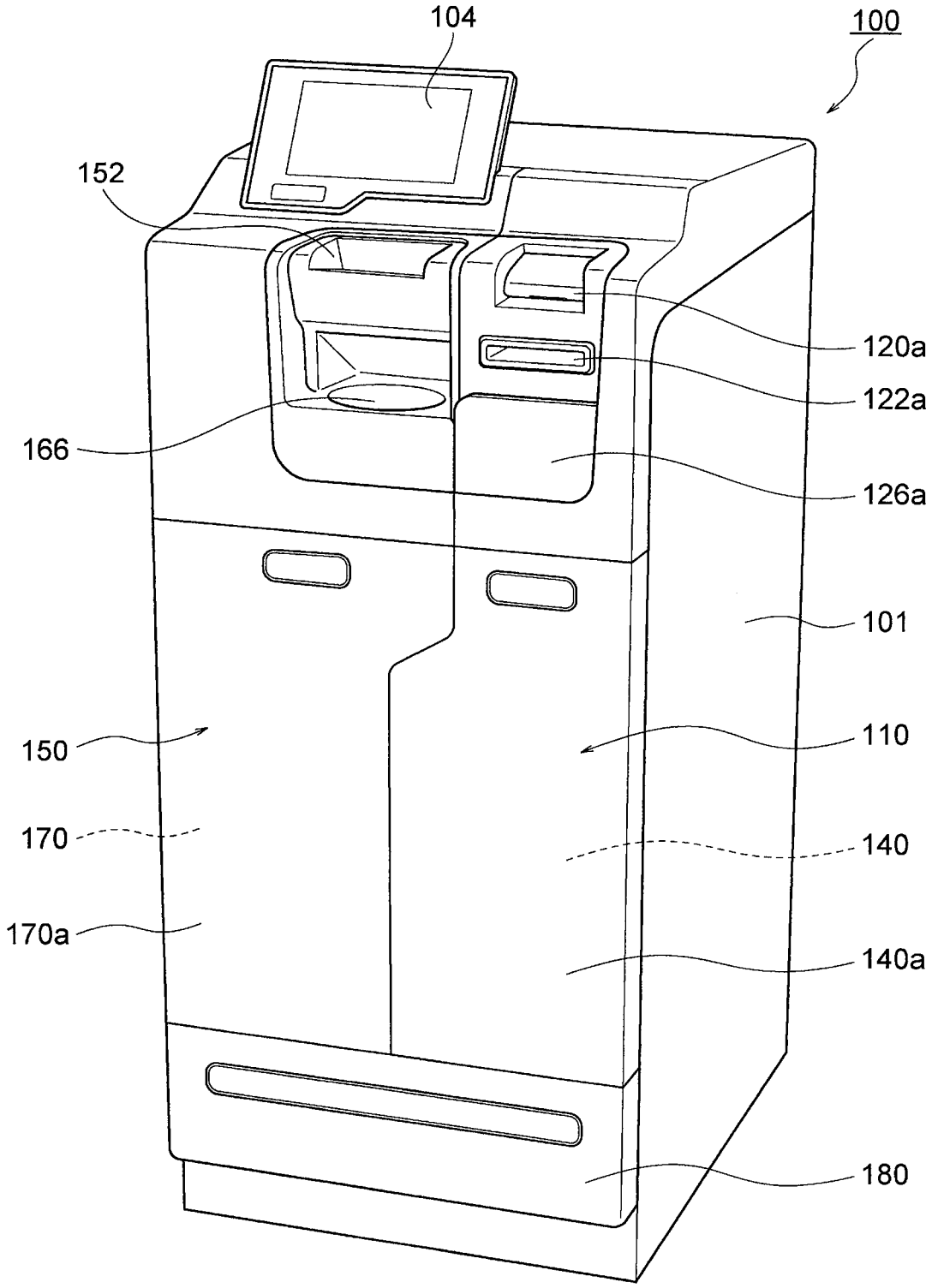
FIG. 2 is a perspective view of an external appearance of a money depositing and dispensing machine in the money management system shown in FIG. 1.
Figure 3:
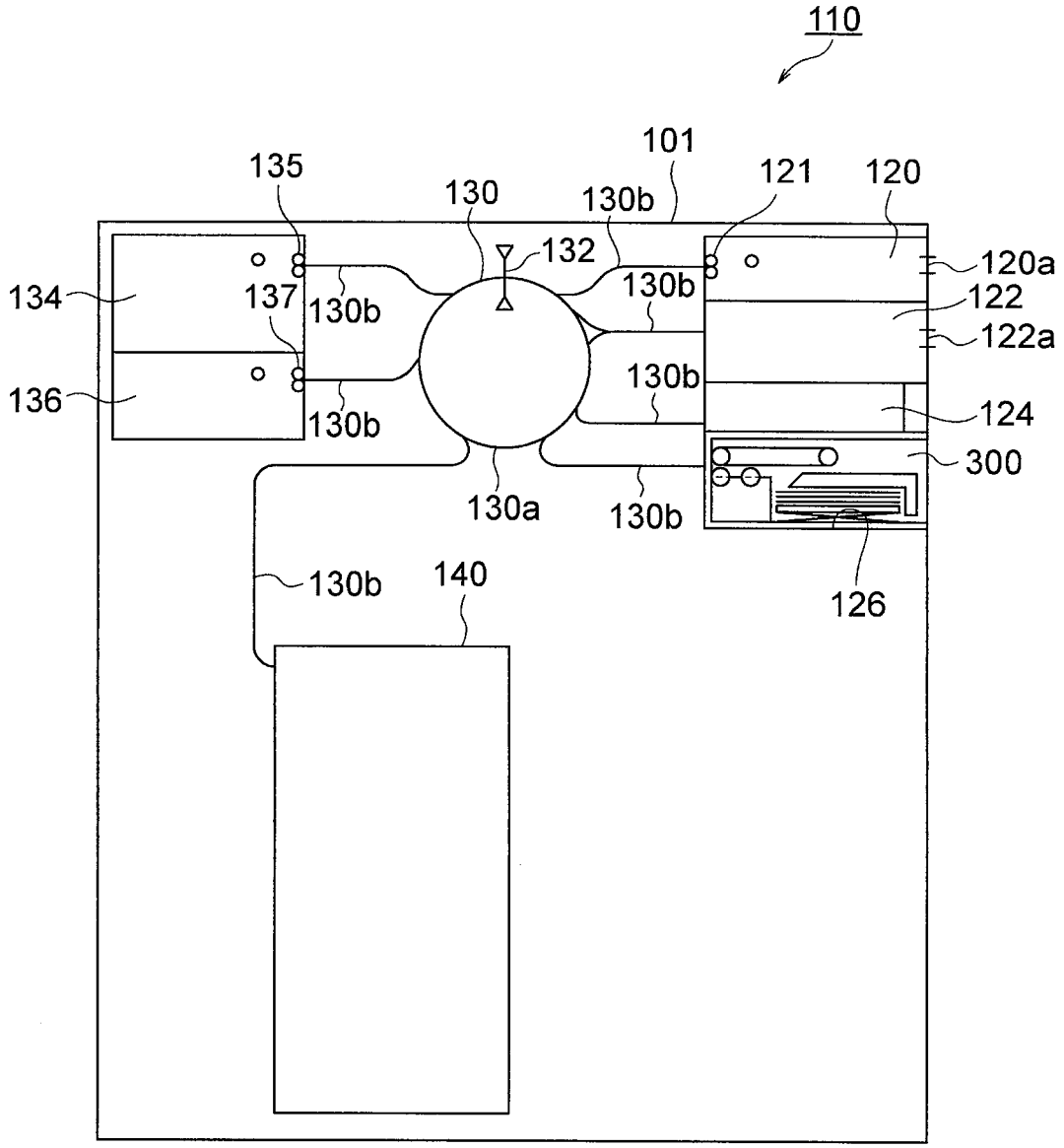
FIG. 3 is an overall structural diagram of an internal configuration of a banknote handling assembly in the money depositing and dispensing machine shown in FIG. 2 when the banknote handling assembly is seen from a side thereof.
Figure 4:
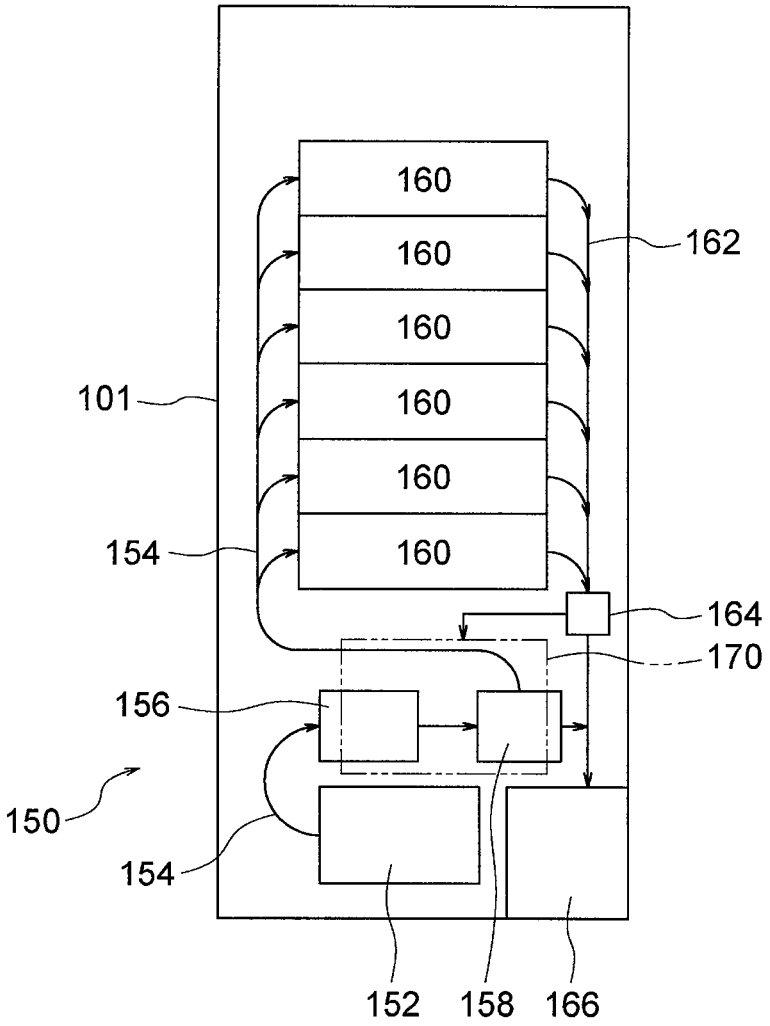
FIG. 4 is an overall structural diagram of an internal configuration of a coin handling assembly in the money depositing and dispensing machine shown in FIG. 2 when the coin handling assembly is seen from above.
Figure 5:
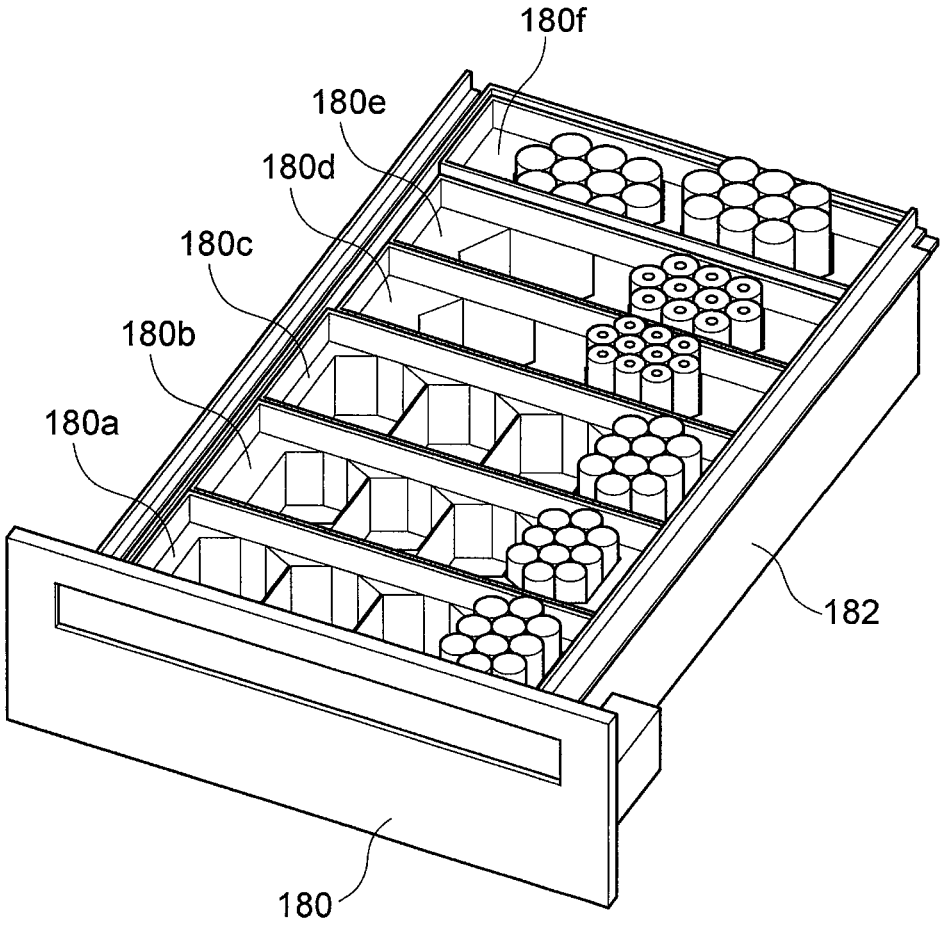
FIG. 5 is a perspective view of a configuration of a drawing unit of a coin-roll storing assembly in the money depositing and dispensing machine shown in FIG. 2.
Figure 6:
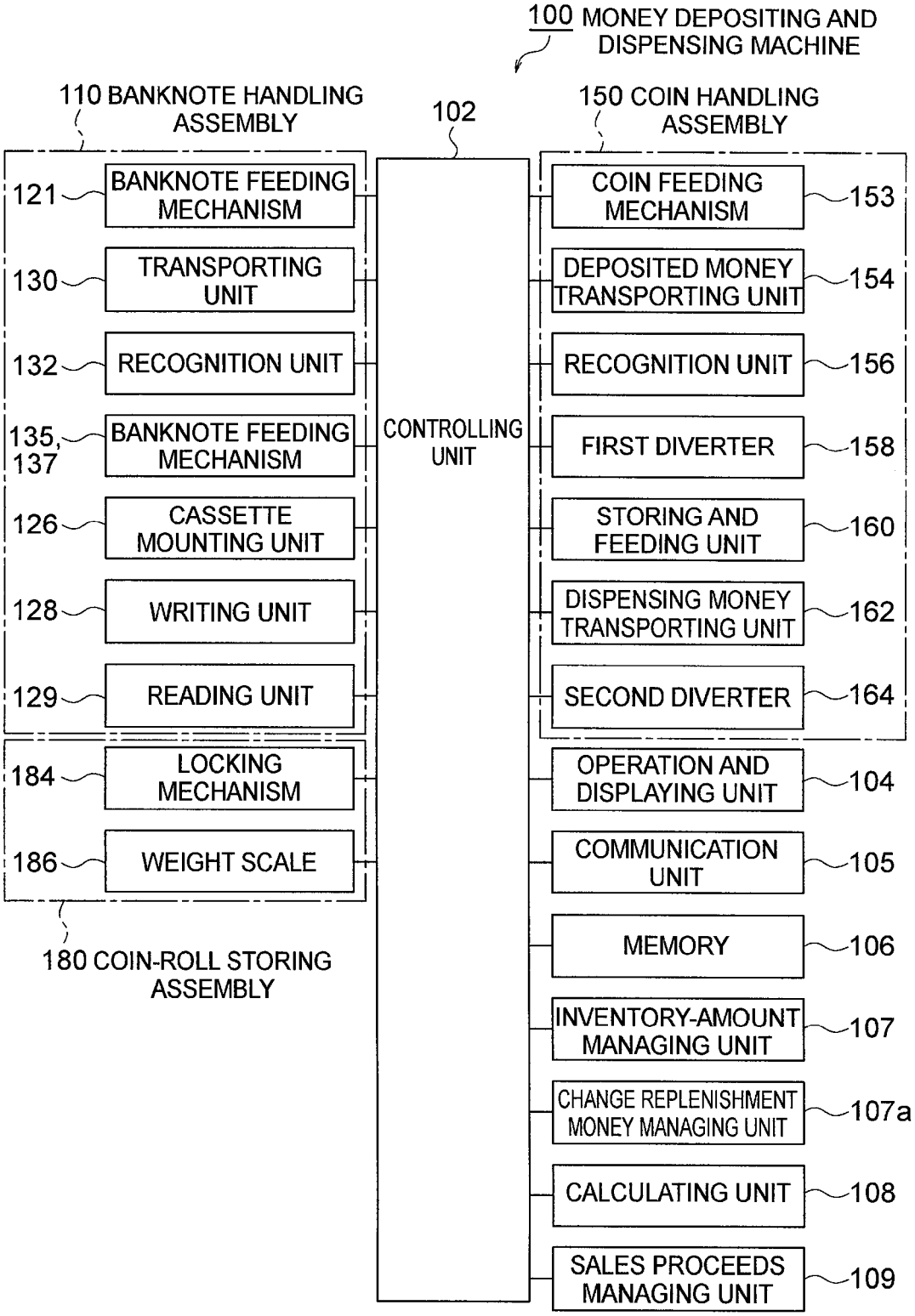
FIG. 6 is a functional block diagram of a configuration of a control system in the money depositing and dispensing machine shown in FIG. 2.
Figure 7:
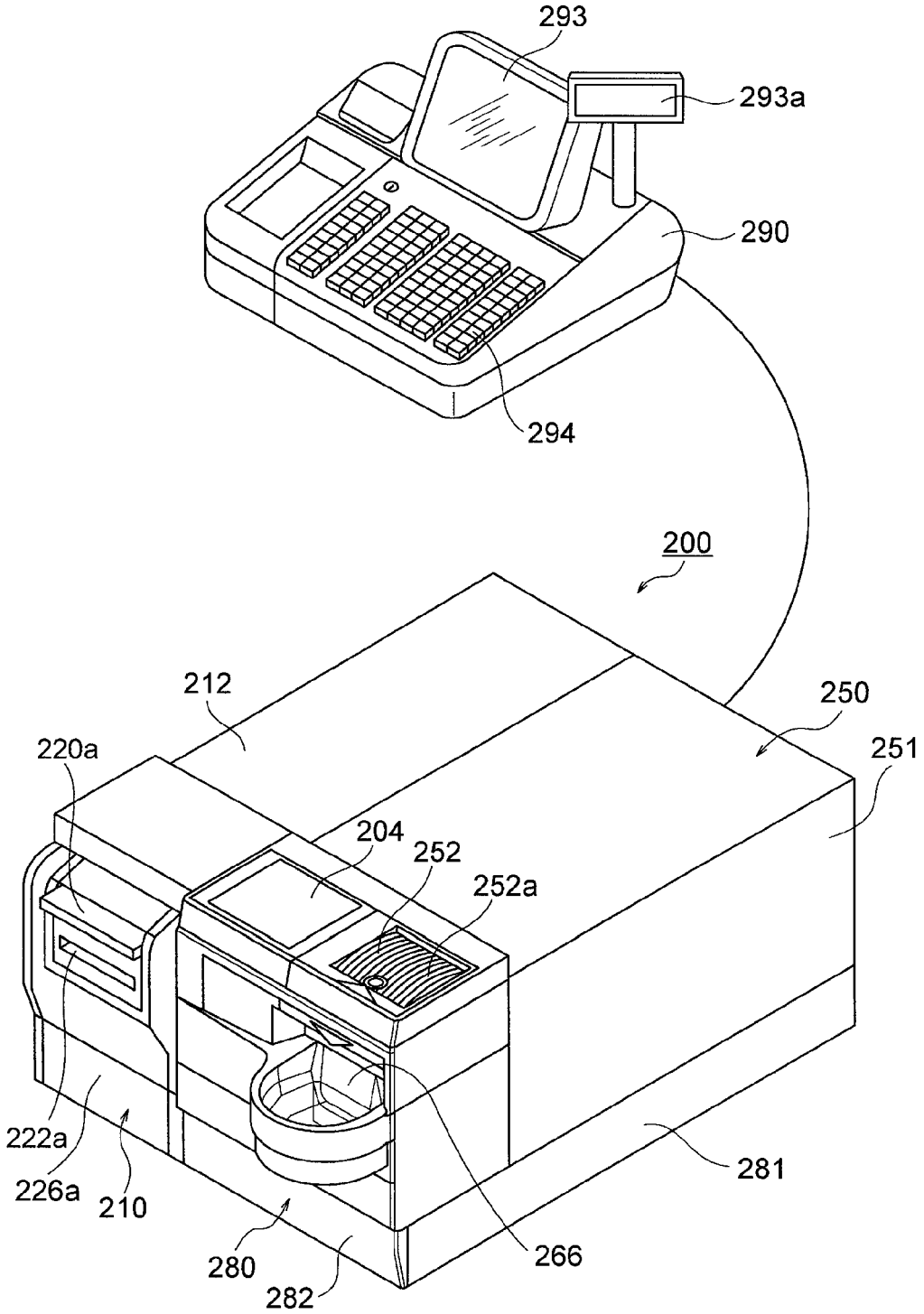
FIG. 7 is a perspective view of an external appearance of a money change machine and a POS register of the money management system shown in FIG. 1.
Figure 8:
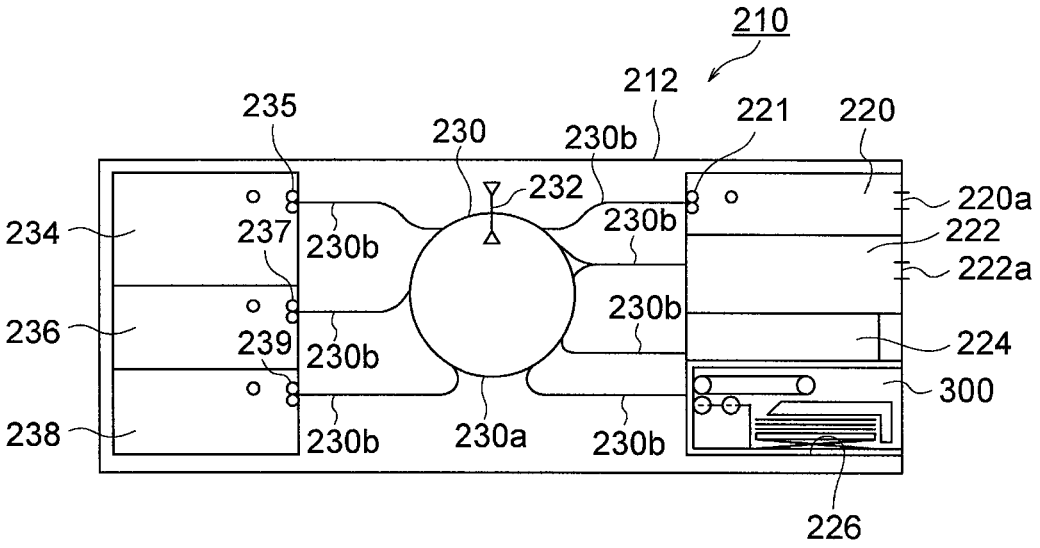
FIG. 8 is an overall structural diagram of an internal configuration of a banknote handling assembly in the money change machine shown in FIG. 7 when the banknote handling assembly is seen from a side thereof.
Figure 9:
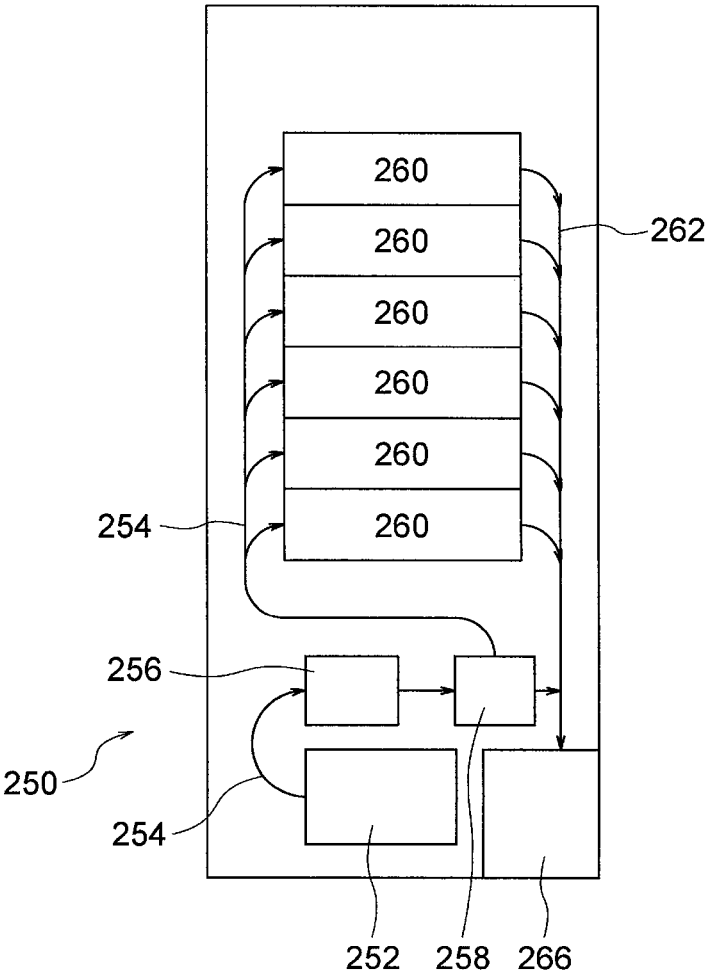
FIG. 9 is an overall structural diagram of an internal configuration of a coin handling assembly in the money change machine shown in FIG. 7 when the coin handling assembly is seen from above.
Figure 10:
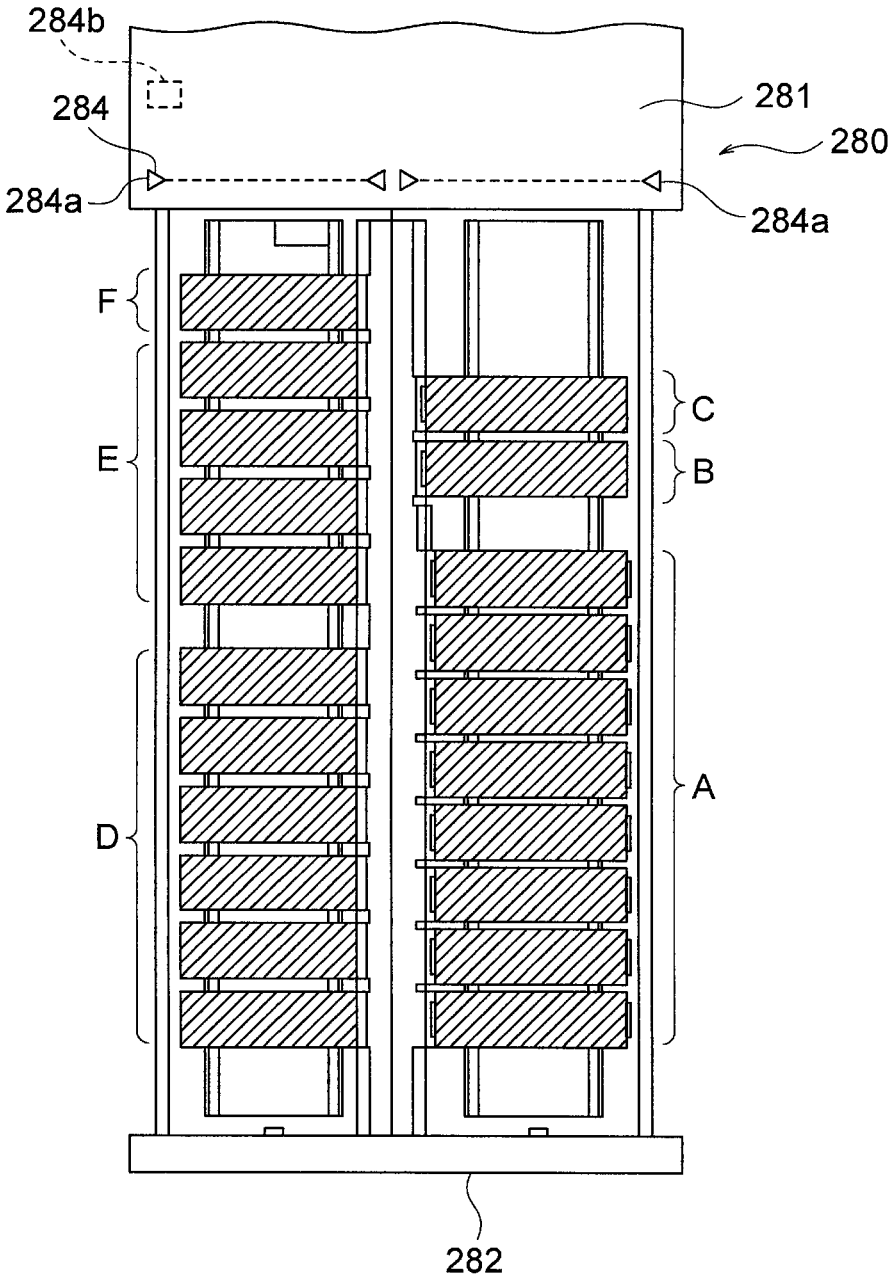
FIG. 10 is an overall structural diagram of a configuration seen from above when a drawer of a coin-roll storing assembly is pulled from a housing in the money change machine shown in FIG. 7.
Figure 11:
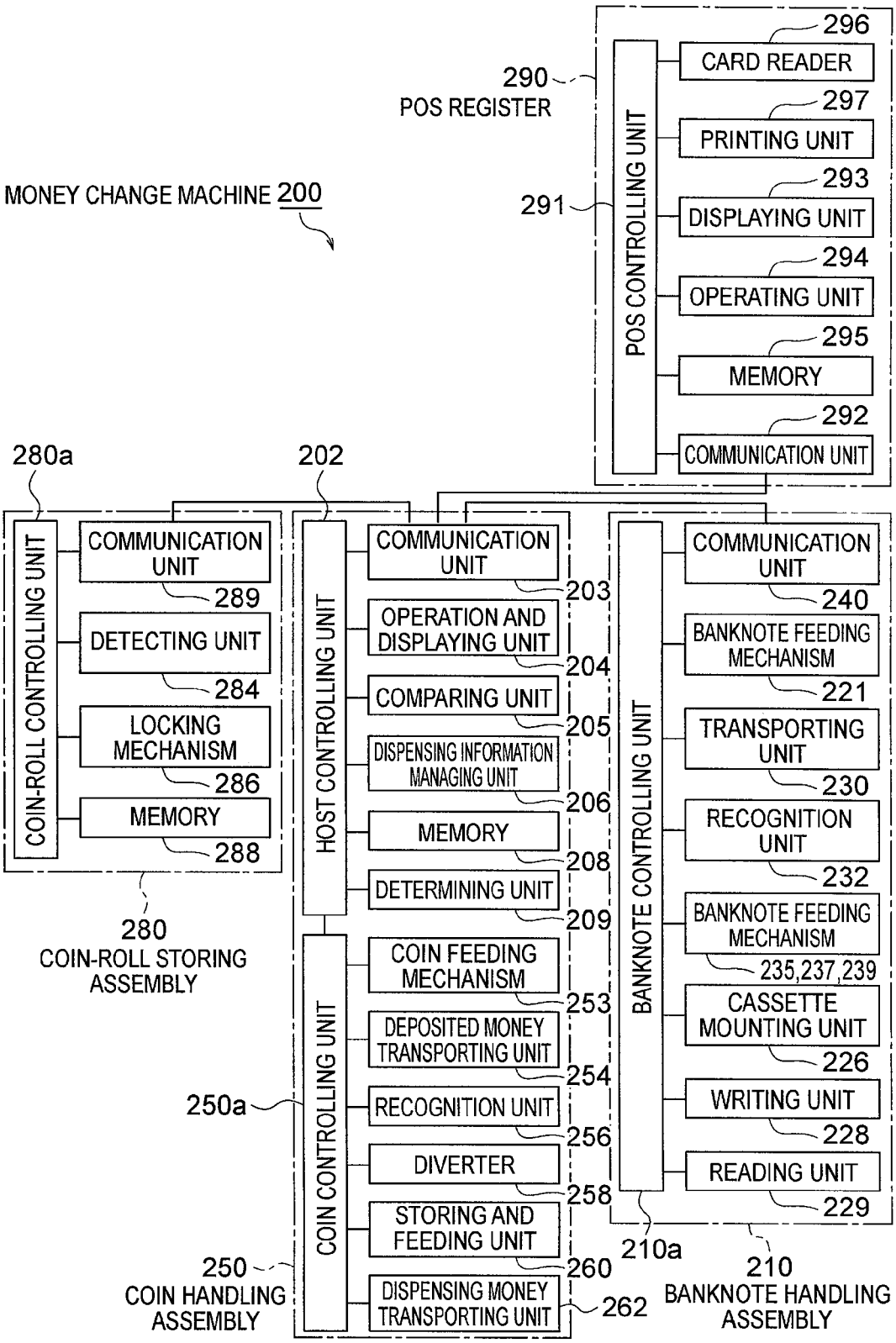
FIG. 11 is a functional block diagram of a configuration of a control system in the money change machine and a POS register shown in FIG. 7.
Figure 12:
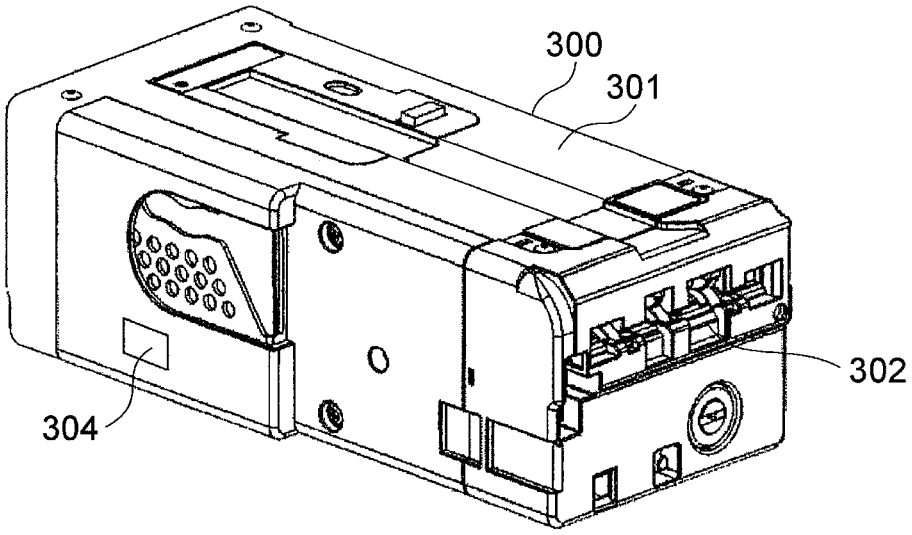
FIG. 12 is a perspective view of an external appearance of a storing cassette that is detachably attachable in any of a cassette mounting unit of the money depositing and dispensing machine and a cassette mounting unit of the money change machine in the money management system shown in FIG. 1.
Figure 13:
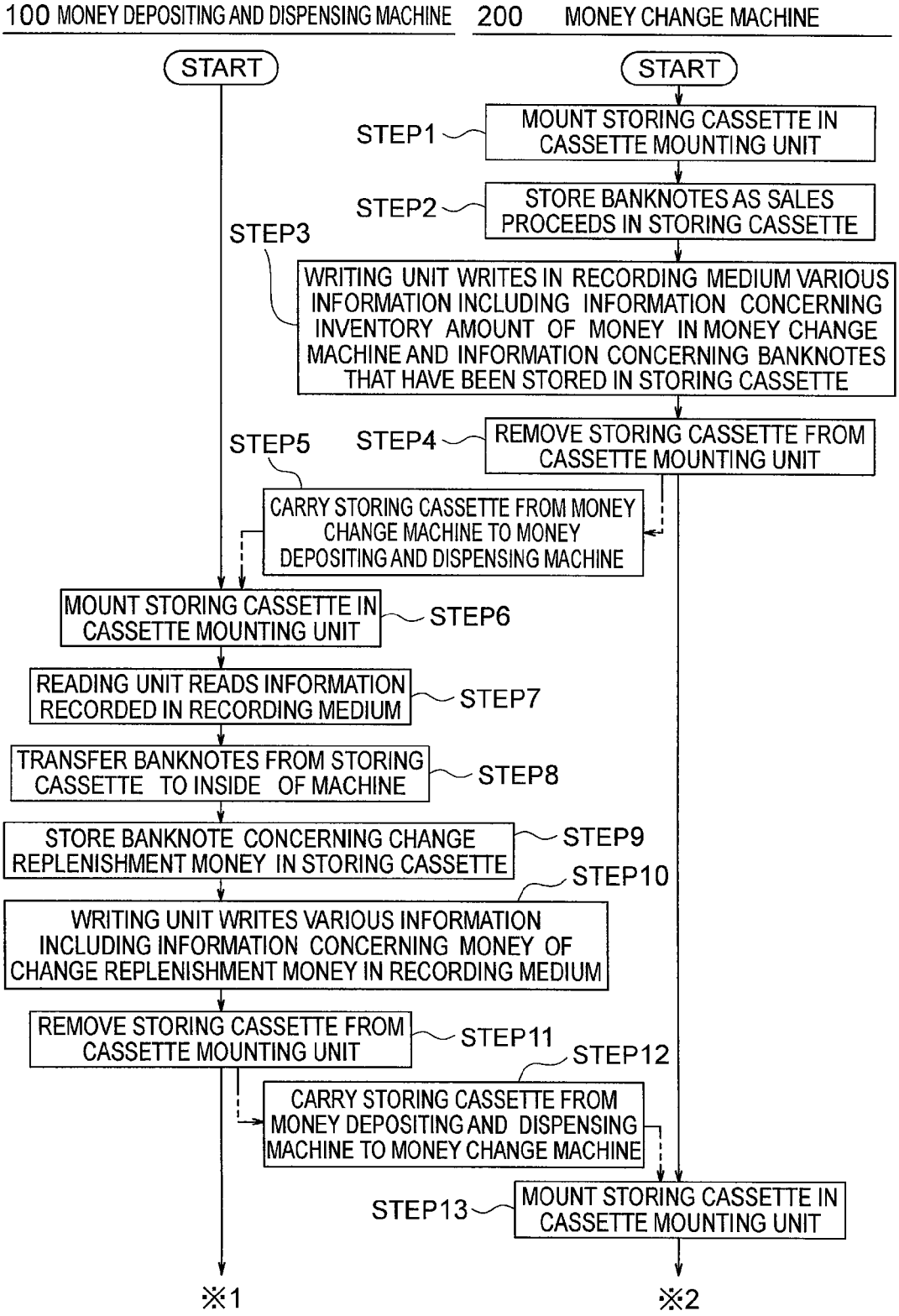
FIG. 13 is a flowchart of operation performed by each of the money depositing and dispensing machine and the money change machine when processing money in the money management system shown in FIG. 1.
Figure 14:
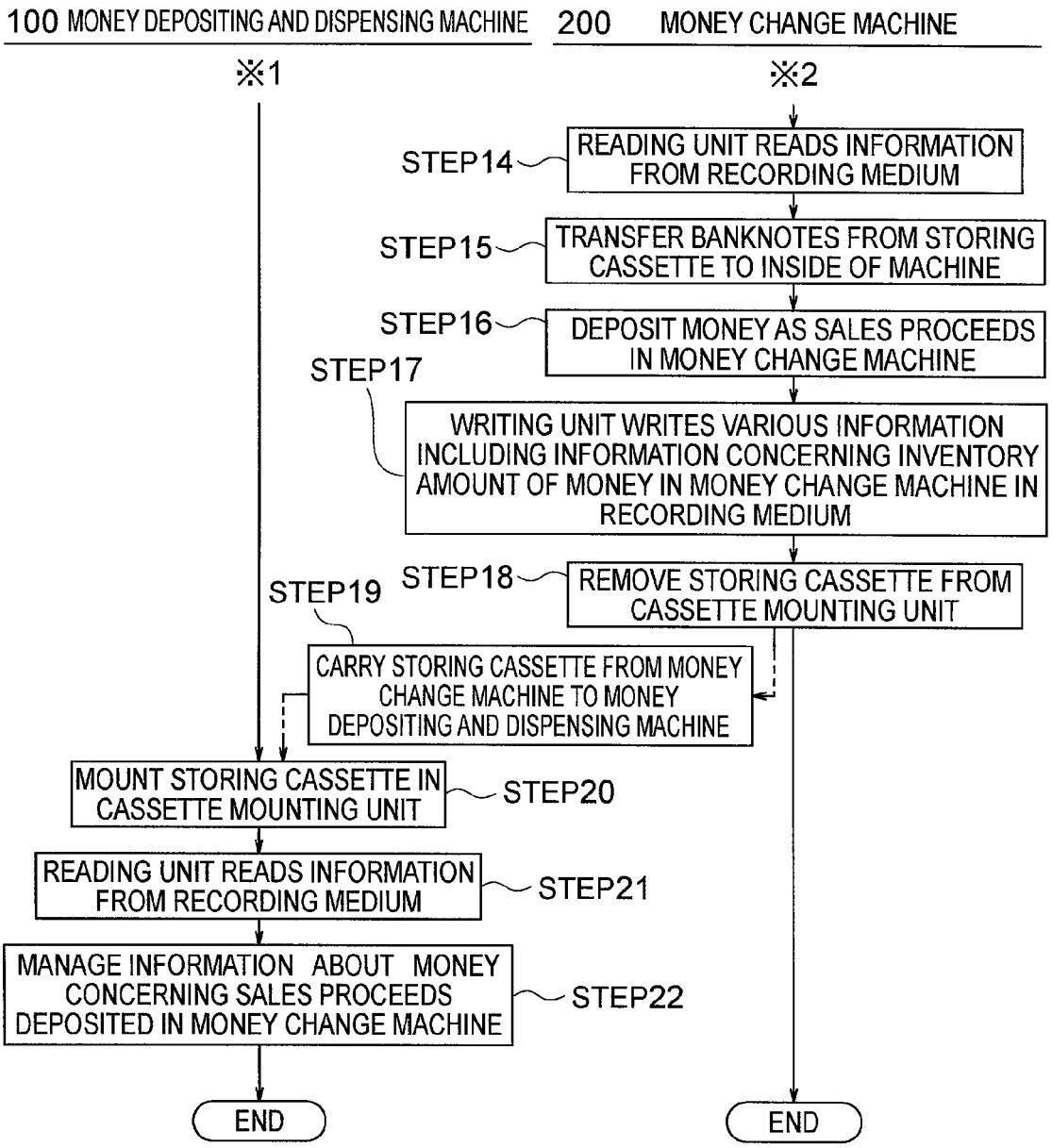
FIG. 14 is a flowchart that is continuation of the flowchart shown in FIG. 13 and shows the operation performed by each of the money depositing and dispensing machine and the money change machine when processing money in the money management system shown in FIG. 1.
Figure 15:
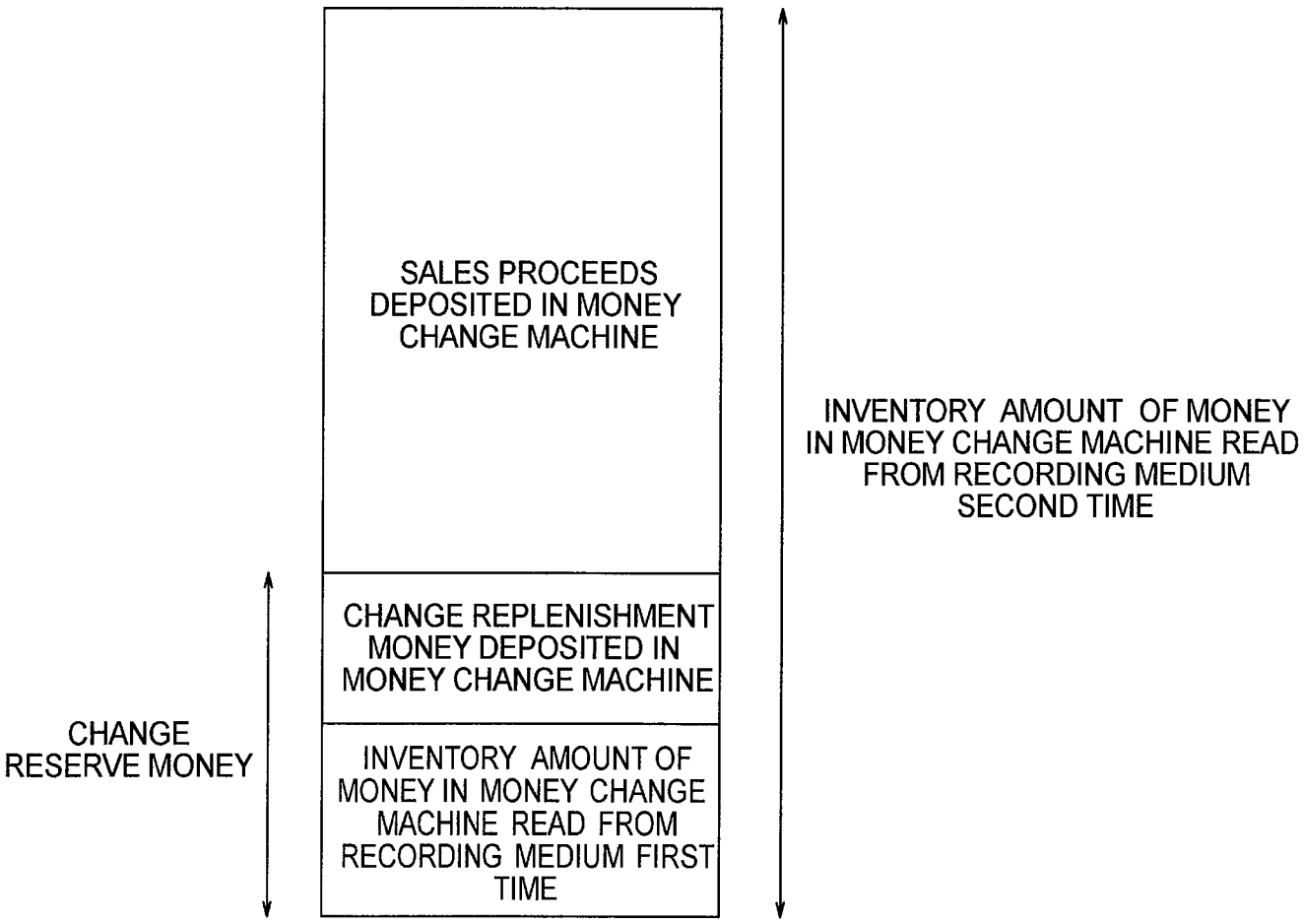
FIG. 15 is an explanatory drawing indicating information about money managed by a sales proceeds managing unit concerning sales proceeds deposited in the money change machine in the money management system shown in FIG. 1.

Exemplary embodiments of the present invention are explained below with reference to the accompanying drawings. FIGS. 1 to 15 are views of a money management system 1 and a money depositing and dispensing machine 100 and a money change machine 200 arranged in the money management system 1 as a money handling apparatus according to the present embodiment. Among them, FIG. 1 is a schematic diagram for explaining a configuration of the money management system 1 according to the present embodiment, and FIG. 2 is a perspective view of an external appearance of the money depositing and dispensing machine 100 in the money management system 1 shown in FIG. 1. Moreover, FIGS. 3 to 5 are views of a configuration of a banknote handling assembly 110, a coin handling assembly 150, and a coin-roll storing assembly 180 respectively in the money depositing and dispensing machine 100 shown in FIG. 2. FIG. 6 is a functional block diagram of a configuration of a control system in the money depositing and dispensing machine 100 shown in FIG. 2. FIG. 7 is a perspective view of an external appearance of the money change machine 200 and a POS (Point of Sale) register 290 of the money management system 1 shown in FIG. 1. Moreover, FIGS. 8 to 10 are views of a configuration of a banknote handling assembly 210, a coin handling assembly 250, and a coin-roll storing assembly 280 respectively in the money change machine 200 shown in FIG. 7. FIG. 11 is a functional block diagram of a configuration of a control system in the money change machine 200 and the POS register 290 shown in FIG. 7. FIG. 12 is a perspective view of an external appearance of a storing cassette 300 that is detachably attachable in any of a cassette mounting unit of the money depositing and dispensing machine 100 and a cassette mounting unit of the money change machine 200 in the money management system 1 shown in FIG. 1. FIGS. 13 and 14 are flowcharts of operation performed by each of the money depositing and dispensing machine 100 and the money change machine 200 when processing money in the money management system 1 shown in FIG. 1. FIG. 15 is an explanatory drawing indicating information concerning money managed by a sales proceeds managing unit relating to sales proceeds deposited in the money change machine 200 in the money management system 1 shown in FIG. 1.

As shown in FIG. 1, in a shop 420 of a commercial facility, such as a convenience store and a supermarket, a store shelf in which various goods are exhibited is installed in a front area in which a customer can enter, and the money change machine 200 and the POS register 290 are installed at a check-out counter in the front area. When a customer makes payment at such a check-out counter, a salesclerk performs the acts of depositing money in the money change machine 200 received from the customer as the consideration of the goods, dispensing money from the money change machine 200 as change and handing the change to the customer, and the like. Moreover, the POS register 290 is used to perform management of information concerning goods purchased by the customer, information concerning the money stored in the money change machine 200, and the like. Moreover, the money depositing and dispensing machine 100, such as a teller machine, for depositing money as the sales proceeds collected from the money change machine 200 is installed in a backyard area (specifically, for example, a money depositing room) of the shop 420 in which entry of the customer is prohibited. Moreover, in the event that money as the change is short in the money change machine 200, money as change replenishment money is dispensed from the money depositing and dispensing machine 100, and the money as the change replenishment money dispensed from the money depositing and dispensing machine 100 is replenished in the money change machine 200. The money management system 1 is constituted by combining the money depositing and dispensing machine 100 and the money change machine 200 in the present embodiment.

As shown in FIG. 1, in the money management system 1 according to the present embodiment, a guard and the like of a cash in transit company 410 removes from the money depositing and dispensing machine 100 later-explained collecting cassettes 140 and 170 in which banknotes and coins have been stored, and the banknotes and the coins together with the collecting cassettes 140 and 170 are collected from the money depositing and dispensing machine 100 toward the cash in transit company 410. Moreover, the guard of the cash in transit company 410 carries change reserve money to be used in the money change machine 200 from the cash in transit company 410 to the shop 420, and the guard stores this money in a safe 422 arranged in the shop 420. In the event that the change reserve money is short in the money depositing and dispensing machine 100, the guard of the cash in transit company 410 removes the money from the safe 422 and deposits the removed money in the money depositing and dispensing machine 100.

As shown in FIG. 1, in the money management system 1 according to the present embodiment, the money depositing and dispensing machine 100 is communicably connected via a LAN (Local Area Network) 404 to a terminal 400 and a user server 402 provided outside of the shop 420. Information about an inventory amount of the money in the money depositing and dispensing machine 100, the guard and the like of the cash in transit company 410, and an operator such as the salesclerk in the shop 420, and the like is managed by using the terminal 400 and the user server 402.

Subsequently, a detailed configuration of the money depositing and dispensing machine 100 and the money change machine 200 in the money management system 1 will be explained.

At first, a configuration of the money depositing and dispensing machine 100, which is arranged in the backyard area of the shop 420, is explained by using FIGS. 2 to 6. As shown in FIG. 2 and the like, the money depositing and dispensing machine 100 according to the present embodiment includes a housing 101 of a substantially cuboidal shape. Inside the housing 101 are arranged the banknote handling assembly 110 that performs a money depositing process and a money dispensing process of banknotes, the coin handling assembly 150 that performs a money depositing process and a money dispensing process of coins, and the coin-roll storing assembly 180 that stores therein rolls of coins (a rod-like member obtained by wrapping a certain number (for example, 20 or 50 pieces) of the coins of the same denomination with a film or a wrapping paper). As shown in FIG. 2, when the money depositing and dispensing machine 100 is seen from a front side thereof, the banknote handling assembly 110 and the coin handling assembly 150 are arranged side-by-side, and the coin-roll storing assembly 180 is arranged below the banknote handling assembly 110 and the coin handling assembly 150.

As shown in FIGS. 2 and 3, the banknote handling assembly 110 includes a banknote receiving unit 120 arranged in a right area on a front surface side of the housing 101, a banknote dispensing unit 122 arranged on the front surface side of the housing 101 below the banknote receiving unit 120, a transporting unit 130 that transports banknotes one by one inside the housing 101, and a plurality of banknote storing units 134 and 136 for storing therein banknotes in the housing 101 and feeding out the banknotes therein. In FIG. 3, the right side of the housing 101 is a surface of the banknote handling assembly 110 towards the operator and the lateral direction in FIG. 3 is the depth direction of the banknote handling assembly 110. As shown in FIG. 3, the transporting unit 130 is constituted of a circling transporting unit **130*a* arranged in an upper central part of the housing 101 and a plurality of connecting transporting units 130*b*. Moreover, the banknote receiving unit 120, the banknote dispensing unit 122, a money reject unit 124, a cassette mounting unit 126 for detachably attaching the later-explained storing cassette 300, the collecting cassette 140, and the two banknote storing units 134 and 136 are arranged around the circling transporting unit 130*a*. Moreover, as shown in FIG. 3, each of the banknote receiving unit 120, the banknote dispensing unit 122, the money reject unit 124, the cassette mounting unit 126, the collecting cassette 140, and the two banknote storing units 134 and 136 are connected to the circling transporting unit 130*a* via each of the connecting transporting units 130*b*. Moreover, a recognition unit 132 is provided to the circling transporting unit 130*a*. The recognition unit 132 recognizes a denomination, authenticity, fitness, face-up/face-down, a transportation state, and the like of the banknote transported by the circling transporting unit 130*a***.

The circling transporting unit **130*a* transports banknotes one by one in either of a clockwise direction and a counterclockwise direction in FIG. 3. Moreover, in the transporting unit 130, a not-shown path switching member for changing the transportation path of the banknote between the circling transporting unit 130*a* and each of the connecting transporting units 130*b* is arranged along the circling transporting unit 130*a***.

As shown in FIGS. 2 and 3, on the front surface of the housing 101 is arranged a banknote inlet **120*a* of the banknote receiving unit 120 and a banknote outlet 122*a* of the banknote dispensing unit 122. Moreover, the front surface side of the cassette mounting unit 126 is provided with a door 126*a*. After opening the door 126*a*, the operator can perform the acts of mounting the storing cassette 300 in the cassette mounting unit 126, removing the storing cassette 300 from the cassette mounting unit 126, and the like. Moreover, as shown in FIG. 6, a writing unit 128 and a reading unit 129 are provided to the cassette mounting unit 126. The writing unit 128 writes various information in a later-explained recording medium 304 arranged on the storing cassette 300 that is mounted in the cassette mounting unit 126. The reading unit 129 reads various information from the recording medium 304. A detailed explanation about the information written in the recording medium 304 by the writing unit 128 and the information read by the reading unit 129 from the recording medium 304** will be given later.

A banknote feeding mechanism 121 is arranged in the banknote receiving unit 120. When it is detected that a banknote, or a plurality of banknotes, is set in the banknote inlet **120*a*, the banknote feeding mechanism 121 is driven whereby the banknotes are fed one by one via the connecting transporting units 130***b* to the circling transporting unit 130*a*.

The banknote dispensing unit 122 dispenses the banknote fed from each of the banknote storing units 134 and 136 to the circling transporting unit 130*a* to the outside of the housing 101 from the banknote outlet 122*a*.

The money reject unit 124 stores therein, among the banknotes fed out at the money dispensing process from each of the banknote storing units 134 and 136, the banknote that cannot be recognized in the recognition unit 132 because of transportation related issues such as overlapping and inclined transportation, as a dispensing reject banknote. Moreover, among the banknotes that are taken in the housing 101 from the banknote receiving unit 120, the banknote that cannot be recognized in the recognition unit 132 at the money depositing process because of dirt, damage, and the like is returned to the banknote dispensing unit 122 as a deposited reject banknote.

Each of the banknote storing units 134 and 136 store therein the banknotes according to a denomination thereof based on a recognition result obtained by the recognition unit 132. In these banknote storing units 134 and 136 are stored the banknotes that are to be dispensed from the money depositing and dispensing machine 100 as the banknotes of the change replenishment money to the money change machine 200. Specifically, for example, JPY 1000 banknotes are stored in the banknote storing unit 134 and JPY 5000 banknotes are stored in the banknote storing unit 136. Note that, JPY 10000 banknotes are stored in the later-explained collecting cassette 140. Moreover, banknote feeding mechanisms 135 and 137 are arranged in the banknote storing units 134 and 136, respectively. The banknotes stored in the banknote storing units 134 and 136 are fed one by one by the banknote feeding mechanisms 135 and 137, respectively, via the connecting transporting units 130*b* to the circling transporting unit 130*a*.

The collecting cassette 140 is housed in a lower part of the housing 101. The banknotes that are to be collected by the cash in transit company 410 are stored in the collecting cassette 140. Specifically, the banknote recognized by the recognition unit 132 is sent by the circling transporting unit 130*a* to the collecting cassette 140 via the connecting transporting unit 130*b*. Moreover, a door 140*a* is arranged on a front surface side of the collecting cassette 140. After opening the door 140*a*, the operator can perform the acts of housing the collecting cassette 140 in the housing 101, removing the collecting cassette 140 from the housing 101, and the like.

A configuration of the coin handling assembly 150 is explained next. As shown in FIGS. 2 and 4, the coin handling assembly 150 includes a coin receiving unit 152 in a left area on the front surface side of the housing 101, a coin dispensing unit 166 arranged below the coin receiving unit 152 on the front surface side of the housing 101, and a plurality of storing and feeding units 160 arranged in the housing 101 and capable of storing therein coins and feeding out the coins.

The coin receiving unit 152 takes the coins, which are deposited from a coin depositing opening, one by one in the housing 101 in the single layer and single row state. More particularly, a coin feeding mechanism 153 (see FIG. 6) constituted by a feeding belt and the like is arranged in the coin receiving unit 152. When it is detected that coins have been deposited in the coin receiving unit 152, the coin feeding mechanism 153 is driven whereby the coins are fed one by one by the coin feeding mechanism 153 inside of the housing 101. Moreover, as shown in FIG. 4, an deposited money transporting unit 154 that transports the coin fed in the housing 101 by the coin receiving unit 152 is connected to the coin receiving unit 152.

As shown in FIG. 4, in the middle of the deposited money transporting unit 154 is arranged a recognition unit 156 and a first diverter 158. The recognition unit 156 recognizes a denomination, authenticity, fitness, face-up/face-down, a transportation state, and the like of the coin. The first diverter 158 causes a coin that is to be dispensed from the coin dispensing unit 166, such as a reject coin, to be diverted from the deposited money transporting unit 154 and guided to a dispensing money transporting unit 162 based on the recognition result of the coin obtained by the recognition unit 156.

On the other hand, a coin that is to be stored in the housing 101, such as a normal coin, is transported by the deposited money transporting unit 154 to a corresponding one of the storing and feeding units 160. The storing and feeding units 160 are capable of storing therein coins according to the denomination of the coins and feeding out the coins. Specifically, for example, six storing and feeding units 160 are provided corresponding to six denominations of coins (JPY 500, JPY 100, JPY 50, JPY 10, JPY 5, JPY 1) that are in circulation in Japan. The coins are stored in the storing and feeding units 160 in an ascending order of the denomination from the upstream side (lower side in FIG. 4) of the deposited money transporting unit 154. A not-shown coin feeding mechanism that feeds coins stored in the storing and feeding unit 160 one by one to the dispensing money transporting unit 162 is arranged in the storing and feeding unit 160.

The dispensing money transporting unit 162 transports the coin fed by the storing and feeding unit 160 to the coin dispensing unit 166. Moreover, the dispensing money transporting unit 162 transports to the coin dispensing unit 166 the reject coin and the like that has been diverted from the deposited money transporting unit 154 by the first diverter 158.

The collecting cassette 170 is arranged in a lower part of the housing 101. The coins that are to be collected by the cash in transit company 410 are stored in the collecting cassette 170. Specifically, as shown in FIG. 4, a second diverter 164 is arranged in the middle part of the dispensing money transporting unit 162, and the coin that is diverted from the dispensing money transporting unit 162 by the second diverter 164 is sent to the collecting cassette 170 and stored therein. A door 170*a* is provided on a front surface side of the collecting cassette 170. After opening the door 170*a*, the operator can perform the acts of mounting the collecting cassette 170 in the housing 101, removing the collecting cassette 170 from the housing 101, and the like.

Next, a configuration of the coin-roll storing assembly 180 is explained. As shown in FIG. 5, the coin-roll storing assembly 180 includes a drawing unit 182 that includes a plurality of storing areas 180*a* to 180*f* in which rolls of coins can be stored for each denomination. The drawing unit 182 can be pulled toward the operator from the inside of the housing 101 of the money depositing and dispensing machine 100. As shown in FIG. 5, when a roll of coins is stored in any of the storing areas 180*a* to 180*f*, the roll of coins is stored so that a longitudinal direction thereof is oriented vertically. After pulling the drawing unit 182 from the inside of the housing 101 of the money depositing and dispensing machine 100, the operator can perform the acts of storing a roll of coins in any of the storing areas 180*a* to 180*f*, removing the roll of coins stored in any of the storing areas 180*a* to 180*f*, and the like. As shown in FIG. 6, a locking mechanism 184 that locks the drawing unit 182 inside the housing 101 is provided to the coin-roll storing assembly 180. While the drawing unit 182 has been locked inside the housing 101, the drawing unit 182 cannot be pulled toward the operator from the inside of the housing 101. A weight scale 186 that measures a weight of the rolls of coins stored in each of the storing areas 180*a* to 180*f* of the drawing unit 182 is provided to the coin-roll storing assembly 180. Based on the weight of the rolls of coins measured by the weight scale 186, a later-explained controlling unit 102 can detect the number of the rolls of coins stored in each of the storing areas 180*a* to 180*f* of the drawing unit 182.

In detecting the number of the rolls of coins stored in each of the storing areas 180*a* to 180*f*, instead of measuring the weight of the rolls of coins by using the weight scale 186, or in addition to measuring the weight of the rolls of coins by using the weight scale 186, the number of the rolls of coins stored in each of the storing areas 180*a* to 180*f* can be detected by using a line sensor or a magnetic sensor. Alternatively, the number of the rolls of coins stored in each of the storing areas 180*a* to 180*f* can be detected by using a combination of the line sensor and the magnetic sensor. Moreover, a line sensor and a magnetic sensor can be arranged in each of the storing areas 180*a* to 180*f*.

As shown in FIG. 5, each of the storing areas 180*a* to 180*f* is partitioned in a plurality of partial areas. In the present embodiment, 10 rolls of coins can be stored in each of the partial areas. However, the number is not limited to 10, and, for example, 5 rolls of coins can be stored in each of the partial areas, or 3 rolls of coins can be stored in each of the partial areas. Alternatively, each of the storing areas 180*a* to 180*f* is can be partitioned in a plurality of partial areas that can store therein rolls of coins of different numbers. Moreover, in the present embodiment, only one coin-roll storing assembly 180 has been provided. However, the number of the coin-roll storing assembly 180 is not limited to one, and more than one coin-roll storing assemblies 180 can be provided. For example, one coin-roll storing assembly 180 can be provided for each denomination of roll of coins, or rolls of coins of a plurality of denominations can be stored in each of two coin-roll storing assemblies 180.

Next, a control system of the money depositing and dispensing machine 100 is explained by using FIG. 6. As shown in FIG. 6, the controlling unit 102 is arranged in the housing 101 of the money depositing and dispensing machine 100 according to the present embodiment. The controlling unit 102 controls the banknote handling assembly 110, the coin handling assembly 150, and the coin-roll storing assembly 180. Specifically, the banknote feeding mechanism 121, the transporting unit 130, the recognition unit 132, the banknote feeding mechanisms 135 and 137, the cassette mounting unit 126, the writing unit 128, the reading unit 129, and the like of the banknote handling assembly 110 are connected to the controlling unit 102. Accordingly, the recognition information of the banknote obtained by the recognition unit 132, and information read by the reading unit 129 from the recording medium 304 arranged on the storing cassette 300 can be sent to the controlling unit 102, and the controlling unit 102 can send various command signals to each of the structural components of the banknote handling assembly 110 to control those structural components. Moreover, the coin feeding mechanism 153, the deposited money transporting unit 154, the recognition unit 156, the first diverter 158, the storing and feeding unit 160, the dispensing money transporting unit 162, the second diverter 164, and the like of the coin handling assembly 150 are connected to the controlling unit 102. Accordingly, the recognition information about the coin obtained by the recognition unit 156 can be sent to the controlling unit 102, and the controlling unit 102 can send various command signals to each of the structural components of the coin handling assembly 150 to control those structural components. The locking mechanism 184, the weight scale 186, and the like of the coin-roll storing assembly 180 are connected to the controlling unit 102. Accordingly, the measurement result of the rolls of coins obtained in the weight scale 186 can be sent to the controlling unit 102, and the controlling unit 102 can control the locking mechanism 184 by sending a command signal to the locking mechanism 184.

As shown in FIG. 6, an operation and displaying unit 104, a communication unit 105, a memory 106, an inventory-amount managing unit 107, a calculating unit 108, and a sales proceeds managing unit 109 are connected to the controlling unit 102. The operation and displaying unit 104 is constituted by a touch panel and the like arranged in an upper part of the housing 101. Various operation screens for operation by an operator, and information concerning the inventory amounts of the money stored in each of the banknote handling assembly 110, the coin handling assembly 150, and the coin-roll storing assembly 180 are displayed on the operation and displaying unit 104. In this operation and displaying unit 104, the operator can input various commands to the controlling unit 102 by touching operation buttons on the operation screen with his/her finger. The communication unit 105 can receive/send various signals from/to the terminal 400 and the user server 402 via the LAN 404. The memory 106 stores therein various information such as the information concerning the inventory amounts of the money stored in each of the banknote handling assembly 110, the coin handling assembly 150, and the coin-roll storing assembly 180, and a handling history of the money in the money depositing and dispensing machine 100. Moreover, in the present embodiment, the information concerning a remaining setting number for each denomination of money relating to the change reserve money in the money change machine 200 is also stored in the memory 106. The remaining setting number for each denomination of money relating to the change reserve money in the money change machine 200 is number of money for each denomination as the change reserve money that have been stored in the money change machine 200, for example, when the business hours of the shop 420 start.

In the present embodiment, change machine information (specifically, information concerning the inventory amount in the money change machine 200) that is information relating to the money change machine 200 is stored in the recording medium 304 arranged on the storing cassette 300 in the money change machine 200. The inventory-amount managing unit 107 manages the inventory amount of money in the money change machine 200 based on the information read by the reading unit 129 from the recording medium 304 of the storing cassette 300. The calculating unit 108 can calculate the number of money for each denomination concerning the change replenishment money that is to be deposited in the money change machine 200 based on the inventory amount of the money in the money change machine 200 managed by the inventory-amount managing unit 107 and the information stored in the memory 106. The sales proceeds managing unit 109 manages information about money concerning sales proceeds deposited in the money change machine 200 based on the information concerning the inventory amount of the money in the money change machine 200 read by the reading unit 129 from the recording medium 304 of the storing cassette 300 and the information concerning the change replenishment money written by the writing unit 128 in the recording medium 304. A detailed explanation about the functions of the inventory-amount managing unit 107, the calculating unit 108, and the sales proceeds managing unit 109 will be given later.

In a variation of the money depositing and dispensing machine 100, a change replenishment money managing unit 107*a* that manages the number of money for each denomination concerning the change replenishment money that is to be deposited in the money depositing and dispensing machine 100 is provided instead of the inventory-amount managing unit 107. A detailed configuration of the money depositing and dispensing machine 100 according to such a variation is explained later.

Subsequently, a detailed configuration of the money change machine 200 arranged in the front area of the shop 420 is explained by referring to FIGS. 7 to 11. As shown in FIG. 7 and the like, the money change machine 200 according to the present embodiment includes the coin handling assembly 250 and the coin-roll storing assembly 280 that are arranged in a vertical direction and the banknote handling assembly 210 that is arranged adjacent to the coin handling assembly 250 and the coin-roll storing assembly 280. Moreover, the POS register 290 is arranged above the banknote handling assembly 210 and the coin handling assembly 250. The banknote handling assembly 210 performs depositing and dispensing of banknotes and the coin handling assembly 250 performs depositing and dispensing of coins. The coin-roll storing assembly 280 stores therein the rolls of coins of each of the denominations in a removable manner. The POS register 290 functions as a management apparatus that manages the money change machine 200.

At first, a concrete configuration of the banknote handling assembly 210 is explained by referring to FIGS. 7 and 8. As shown in FIGS. 7 and 8, the banknote handling assembly 210 includes a housing 212 having substantially cuboidal shape, a banknote receiving unit 220 arranged on a front surface side of the housing 212, a banknote dispensing unit 222 arranged on the front surface of the housing 212 but below the banknote receiving unit 220, a transporting unit 230 that transports banknotes one by one inside the housing 212, and a plurality of banknote storing units 234, 236, 238 for storing therein banknotes in the housing 212 and feeding out the banknotes therein. In FIG. 8, the right side of the housing 212 is a surface of the banknote handling assembly 210 towards the operator and the lateral direction in FIG. 8 is the depth direction of the banknote handling assembly 210. As shown in FIG. 8, the transporting unit 230 is constituted of a circling transporting unit 230*a* arranged in a central part of the housing 212 and a plurality of connecting transporting units 230*b*. Moreover, the banknote receiving unit 220, the banknote dispensing unit 222, a money reject unit 224, a cassette mounting unit 226 for detachably attaching the later-explained storing cassette 300, and the three banknote storing units 234, 236, 238 are arranged around the circling transporting unit 230*a*. Moreover, as shown in FIG. 8, each of the banknote receiving unit 220, the banknote dispensing unit 222, the money reject unit 224, the cassette mounting unit 226, and the three banknote storing units 234, 236, 238 are connected to the circling transporting unit 230*a* via each of the connecting transporting units 230*b*. Moreover, a recognition unit 232 is arranged in the circling transporting unit 230*a*. The recognition unit 232 recognizes a denomination, authenticity, fitness, face-up/face-down, a transportation state, and the like of the banknote transported by the circling transporting unit 230*a*.

The circling transporting unit 230*a* transports banknotes one by one in either of a clockwise direction and a counterclockwise direction in FIG. 8. Moreover, in the transporting unit 230, a not-shown path switching member for changing the transportation path of the banknote between the circling transporting unit 230*a* and each of the connecting transporting units 230*b* is arranged along the circling transporting unit 230*a*.

As shown in FIGS. 7 and 8, on the front surface of the housing 212 is arranged a banknote inlet 220*a* of the banknote receiving unit 220 and a banknote outlet 222*a* of the banknote dispensing unit 222. Moreover, the front surface side of the cassette mounting unit 226 is provided with a door 226*a*. After opening the door 226*a*, the operator can perform the acts of mounting the storing cassette 300 in the cassette mounting unit 226, removing the storing cassette 300 from the cassette mounting unit 226, and the like. Moreover, as shown in FIG. 11, a writing unit 228 and a reading unit 229 are arranged in the cassette mounting unit 226. The writing unit 228 writes various information as the change machine information of the money change machine 200 in the later-explained recording medium 304 arranged on the storing cassette 300 that is mounted in the cassette mounting unit 226. The reading unit 229 reads various information from the recording medium 304. A detailed explanation about the information written in the recording medium 304 by the writing unit 228 and the information read by the reading unit 229 from the recording medium 304 will be given later.

A banknote feeding mechanism 221 is provided to the banknote receiving unit 220. When it is detected that a banknote, or a plurality of banknotes, is set in the banknote inlet 220*a*, the banknote feeding mechanism 221 is driven whereby the banknotes are fed one by one via the connecting transporting units 230*b* to the circling transporting unit 230*a*.

The banknote dispensing unit 222 dispenses the banknote fed from each of the banknote storing units 234, 236, 238 to the circling transporting unit 230*a* to the outside of the housing 212 from the banknote outlet 222*a*.

The money reject unit 224 stores therein, among the banknotes fed out at the money dispensing process from each of the banknote storing units 234, 236, 238 the banknote that cannot be recognized in the recognition unit 232 because of transportation related issues such as overlapping and inclined transportation, as a dispensing reject banknote. Moreover, among the banknotes that are taken in the housing 212 from the banknote receiving unit 220, the banknote that cannot be recognized in the recognition unit 232 at the money depositing process because of dirt, damage, and the like is returned to the banknote dispensing unit 222 as a deposited reject banknote.

Each of the banknote storing units 234, 236, 238 store therein the banknotes according to a denomination thereof based on a recognition result obtained by the recognition unit 232. In these banknote storing units 234, 236, 238 are stored the banknotes that are deposited as the sales proceeds in the banknote handling assembly 210 and the banknotes that are to be dispensed as the change. Specifically, for example, JPY 1000 banknotes are stored in the banknote storing unit 234, JPY 2000 banknotes and JPY 5000 banknotes are stored in mixed state in the banknote storing unit 236, and JPY 10000 banknotes are stored in the banknote storing unit 238. Moreover, banknote feeding mechanisms 235, 237, 239 are arranged in the banknote storing units 234, 236, 238, respectively. The banknotes stored in the banknote storing units 234, 236, 238 are fed one by one by the banknote feeding mechanisms 235, 237, 239, respectively, via the connecting transporting units 230*b* to the circling transporting unit 230*a*.

Next, a configuration of the coin handling assembly 250 is explained. As shown in FIGS. 7 and 9, the coin handling assembly 250 includes a housing 251 having a substantially cuboidal shape, a coin receiving unit 252 arranged on a front surface side of the housing 251, a coin dispensing unit 266 arranged on the front surface side of the housing 251 and below the coin receiving unit 252, and a plurality of storing and feeding units 260 that is arranged in the housing 251 and capable of storing therein coins and feeding out the coins.

The coin receiving unit 252 takes the coins, which are deposited from a coin depositing opening, one by one in the housing 251 in the single layer and single row state. More specifically, a coin feeding mechanism 253 (see FIG. 11) constituted by a feeding belt and the like is arranged in the coin receiving unit 252, and when it is detected that coins have been deposited in the coin receiving unit 252, the coin feeding mechanism 253 is driven whereby the coins are fed one by one in the housing 251 by the coin feeding mechanism 253. Moreover, as shown in FIG. 9, an deposited money transporting unit 254 that transports the coins fed in the housing 251 by the coin receiving unit 252 is connected to the coin receiving unit 252.

As shown in FIG. 9, in the middle of the deposited money transporting unit 254 is arranged a recognition unit 256 and a diverter 258. The recognition unit 256 recognizes a denomination, authenticity, fitness, face-up/face-down, a transportation state, and the like of the coin. The diverter 258 causes a coin that is to be dispensed from the coin dispensing unit 266, such as a reject coin, to be diverted from the deposited money transporting unit 254 and guided to a dispensing money transporting unit 262 based on the recognition result of the coin obtained by the recognition unit 256.

On the other hand, a coin that is to be stored in the housing 251, such as a normal coin, is transported by the deposited money transporting unit 254 to a corresponding one of the storing and feeding units 260. The storing and feeding units 260 are capable of storing therein coins according to the denomination of the coins and feeding out the coins therein. Specifically, for example, six storing and feeding units 260 are provided corresponding to six denominations of coins (JPY 500, JPY 100, JPY 50, JPY 10, JPY 5, JPY 1) that are in circulation in Japan. The coins are stored in the storing and feeding units 260 in an ascending order of the denomination from the upstream side (lower side in FIG. 9) of the deposited money transporting unit 254. A not-shown coin feeding mechanism that feeds coins stored in the storing and feeding units 260 one by one to the dispensing money transporting unit 262 is arranged in the storing and feeding unit 260.

The dispensing money transporting unit 262 transports the coin fed by the storing and feeding unit 260 to the coin dispensing unit 266. Moreover, the dispensing money transporting unit 262 transports to the coin dispensing unit 266 the reject coin and the like that has been diverted from the deposited money transporting unit 254 by the diverter 258.

Next, a concrete configuration of the coin-roll storing assembly 280 is explained. As shown in FIGS. 7 and 10, the coin-roll storing assembly 280 includes a housing 281 having a substantially cuboidal shape and with a side surface thereof toward the operator open, and a drawer 282 that is storable in the housing 281 and that can be pulled out from the housing 281 toward the operator. Two rows of rolls of coins for each denomination, for example, can be stored in the drawer 282 (the rolls of coins for each denomination stored in the drawer 282 are shown with oblique line pattern in FIG. 10). The drawer 282 includes a plurality of storing units (pocket) each of which can store therein one roll of coins, and the number and the position of the roll of coins to be stored for each denomination in each of the storing units of the drawer 282 is previously set. Specifically, in FIG. 10, eight rolls of coins of JPY 100 can be stored in an area shown with a reference letter A, one roll of coins of JPY 500 can be stored in an area shown with a reference letter B, and one roll of coins of JPY 50 can be stored in an area shown with a reference letter C. Moreover, in FIG. 10, six rolls of coins of JPY 10 can be stored in an area shown with a reference letter D, four rolls of coins of JPY 1 can be stored in an area shown with a reference letter E, and one roll of coins of JPY 5 can be stored in an area shown with a reference letter F.

As shown in FIG. 11, a locking mechanism 286 that locks the drawer 282 inside the housing 281 when the drawer 282 is completely stored in the housing 281 is arranged in the housing 281 of the coin-roll storing assembly 280. When the locking mechanism 286 locks the drawer 282 inside the housing 281, the drawer 282 cannot be pulled out from the housing 281 toward the operator, so that the roll of coins cannot be removed from the drawer 282.

A detecting unit 284 is arranged near the front opening surface of the housing 281 of the coin-roll storing assembly 280. The detecting unit 284 detects the number of rolls of coins for each denomination that have been stored in the drawer 282 when the drawer 282 is pulled out toward the operator or when the drawer 282 is returned inside the housing 281. Specifically, as shown in FIG. 10 and the like, the detecting unit 284 includes a pair of optical sensors 284*a*, left and right, and a rotary encoder 284*b* that detects the amount of pulling out of the drawer 282 from the housing 281. Each of the optical sensors 284*a* includes a light emitting element and a photodetecting element. The light emitted by the light emitting element passes along an optic axis that extends in a width direction of the coin-roll storing assembly 280 (left-right direction in FIG. 10) toward the photodetecting element. When the drawer 282 is completely stored inside the housing 281 or the drawer 282 is completely pulled out from the housing 281, the light emitted by the light emitting element is detected by the photodetecting element in each of the optical sensors 284*a*. In contrast, while the drawer 282 is being pulled out from the housing 281 toward the operator or while the drawer 282 is being returned inside the housing 281, because the light emitted by the light emitting element is blocked by the roll of coins stored in the drawer 282 and does not reach the photodetecting element, the presence/absence of a hole in the roll of coins and a diameter of the roll of coins can be detected. As explained above, because the number and the position of the roll of coins for each denomination that can be stored in the drawer 282 has been set previously, the number of rolls of coins for each denomination stored in the drawer 282, whether the rolls of coins have been stored correctly in a predetermined position thereof inside the drawer 282, and the like can be detected based on the presence/absence of a hole in the roll of coins or the diameter of the roll of coins detected by the optical sensors 284*a* and the amount of the pulling out of the drawer 282 from the housing 281 detected by the rotary encoder 284*b*.

The configuration of the coin-roll storing assembly 280 according to the present embodiment is not limited to that explained above. As an alternative configuration of the coin-roll storing assembly 280, a configuration in which, as the detecting unit 284 that detects the number of the rolls of coins for each denomination stored in the drawer 282, a sensor that detects the presence/absence of the roll of coins and the denomination (material) of the roll of coins stored in the storing unit of the drawer 282 can be arranged in each of the storing units (pockets).

A concrete configuration of the POS register 290 is explained below. As shown in FIGS. 7 and 11, the POS register 290 includes a POS controlling unit 291, a displaying unit 293, such as display monitor, and an operating unit 294, such as operating keys, that are connected to the POS controlling unit 291. The operating unit 294 can be operated by the operator. The operator can input various commands to the POS controlling unit 291 by operating the operating unit 294. The displaying unit 293 can display various information such as handling states of the banknotes and the coins in the banknote handling assembly 210 and the coin handling assembly 250, and information relating to the inventory amounts and the like about the banknotes and the coins stored in the banknote handling assembly 210 and the coin handling assembly 250. Moreover, the POS register 290 includes an additional displaying unit 293*a* that can be seen by the customer. The information can be displayed on the additional displaying unit 293*a* instead of displaying the information on the displaying unit 293, or the same information can be displayed on the displaying unit 293 and the additional displaying unit 293*a*. Moreover, the POS register 290 is provided with a card reader 296 and a printing unit 297 (see FIG. 11, not shown in FIG. 7). The card reader 296 acquires information relating to an identification (ID), the authority and the like of the operator, such as the salesclerk, by reading an identification card (ID card) card carried by the operator. The printing unit 297 includes, for example, a printer. The printing unit 297, in addition to printing a sales receipt and a total sales receipt, prints on a receipt information such as inventory amounts and the like about the banknotes and the coins stored in the banknote handling assembly 210 and the coin handling assembly 250.

Next, a control system of the money change machine 200 is explained by using FIG. 11. As shown in FIG. 11, the coin handling assembly 250 includes a host controlling unit 202 and a coin controlling unit 250*a*. The host controlling unit 202 and the coin controlling unit 250*a* are connected to each other. Moreover, the banknote handling assembly 210 includes a banknote controlling unit 210*a*. The banknote controlling unit 210*a* is connected to the host controlling unit 202 of the coin handling assembly 250. The coin-roll storing assembly 280 includes a coin-roll controlling unit 280*a*. The coin-roll controlling unit 280*a* is connected to the host controlling unit 202 of the coin handling assembly 250. The POS controlling unit 291 included in the POS register 290 is also connected to the host controlling unit 202 of the coin handling assembly 250. Though not shown, the POS controlling unit 291 of the POS register 290 is communicably connected to a host terminal such as a shop server.

As shown in FIG. 11, a communication unit 203 that communicates with the banknote handling assembly 210, the coin-roll storing assembly 280 and the POS register 290 respectively, an operation and displaying unit 204, a comparing unit 205, a dispensing information managing unit 206, a memory 208, and a determining unit 209 are connected to the host controlling unit 202 of the coin handling assembly 250. The host controlling unit 202 transmits/receives signals to/from the banknote controlling unit 210*a* of the banknote handling assembly 210, the coin-roll controlling unit 280*a* of the coin-roll storing assembly 280, and the POS controlling unit 291 of the POS register 290 by using the communication unit 203. The operation and displaying unit 204 includes a touch panel and the like arranged on the top surface of the housing 251 of the coin handling assembly 250. An operation screen to be operated by the operator and the information concerning the inventory amounts of the money stored in each of the banknote handling assembly 210, the coin handling assembly 250, and the coin-roll storing assembly 280 are displayed on the operation and displaying unit 204. In this operation and displaying unit 204, the operator can input various commands to the host controlling unit 202 by touching operation buttons on the operation screen with his/her finger. The memory 208 stores therein various pieces of information such as the information concerning the inventory amounts of the money stored in each of the banknote handling assembly 210, the coin handling assembly 250, and the coin-roll storing assembly 280, and a handling history of the money in the money change machine 200. The comparing unit 205 compares the number of money for each denomination concerning the change replenishment money deposited in the money change machine 200 and the number of money for each denomination concerning the change replenishment money obtained from information read by the reading unit 229 from the recording medium 304 arranged on the storing cassette 300. The dispensing information managing unit 206 manages the information (among various pieces of information, information relating to the roll of coins) relating to the money dispensed from the money depositing and dispensing machine 100 based on the information read by the reading unit 229 from the recording medium 304 arranged on the storing cassette 300. The determining unit 209 determines whether the number of rolls of coins for each denomination deposited in the drawer 282 of the coin-roll storing assembly 280, which is detected by the detecting unit 284, and the number of rolls of coins for each denomination dispensed from the money depositing and dispensing machine 100, which is read by the reading unit 229 from the recording medium 304 arranged on the storing cassette 300 match with each other. The detailed explanation about the functions of the comparing unit 205, the dispensing information managing unit 206, and the determining unit 209 will be given later.

A communication unit 240, the banknote feeding mechanism 221, the transporting unit 230, the recognition unit 232, the banknote feeding mechanisms 235, 237, 239, the cassette mounting unit 226, the writing unit 228, the reading unit 229, and the like are connected to the banknote controlling unit 210*a* of the banknote handling assembly 210. Accordingly, the recognition information of the banknote obtained by the recognition unit 232, and information read by the reading unit 229 from the recording medium 304 arranged on the storing cassette 300 can be sent to the banknote controlling unit 210*a*, and the banknote controlling unit 210*a* can send various command signals to each of the structural components of the banknote handling assembly 210 to control those structural components. Moreover, the banknote controlling unit 210*a* can transmit/receive signals to/from the host controlling unit 202 of the coin handling assembly 250 by using the communication unit 240.

Moreover, the coin feeding mechanism 253, the deposited money transporting unit 254, the recognition unit 256, the diverter 258, the storing and feeding units 260, the dispensing money transporting unit 262, and the like are connected to the coin controlling unit 250*a* of the coin handling assembly 250. The recognition information of the coin obtained by the recognition unit 256 is sent to the coin controlling unit 250*a*, and the coin controlling unit 250*a* can send various command signals to each of the structural components of the coin handling assembly 250 to control those structural components.

A communication unit 289, the detecting unit 284, the locking mechanism 286, a memory 288, and the like are connected to the coin-roll controlling unit 280*a* of the coin-roll storing assembly 280. The detection information of the roll of coins obtained by the detecting unit 284 is sent to the coin-roll controlling unit 280*a*, and the coin-roll controlling unit 280*a* can control the locking mechanism 286 by sending a command signal to the locking mechanism 286. Moreover, the coin-roll controlling unit 280*a* can transmit/receive signals to/from the host controlling unit 202 of the coin handling assembly 250 by using the communication unit 289. The information and the like about the inventory amount of the rolls of coins that have been stored in the drawer 282 of the coin-roll storing assembly 280 is stored in the memory 288.

The displaying unit 293, the operating unit 294, a memory 295, a communication unit 292, the card reader 296, the printing unit 297, and the like are communicably connected to the POS controlling unit 291 of the POS register 290. Accordingly, a command input into the operating unit 294 by the operator is sent from the operating unit 294 to the POS controlling unit 291, and the information concerning the ID card of the operator, such as the salesclerk, read by the card reader 296 is sent to the POS controlling unit 291. Moreover, the POS controlling unit 291 causes the displaying unit 293 to display various information by sending a command to the displaying unit 293. The POS controlling unit 291 can cause the additional displaying unit 293*a* to display the information instead of displaying the same on the displaying unit 293, or can cause both the displaying unit 293 and the additional displaying unit 293*a* to display the same information. Moreover, the POS controlling unit 291 can cause the printing unit 297 to print various information on a receipt and the like by sending a command to the printing unit 297. Moreover, the POS controlling unit 291 of the POS register 290 can transmit/receive signals to/from the host controlling unit 202 of the coin handling assembly 250 and a not-shown host terminal such as a shop server by using the communication unit 292. Various information received from the banknote handling assembly 210, the coin handling assembly 250, and the like is stored in the memory 295 as the change machine information of the money change machine 200. For example, the information is the information relating to the handling states of the coins and the banknotes in the banknote handling assembly 210 and the coin handling assembly 250, the information relating to the inventory amounts of the coins, the banknotes, the rolls of coins that have been stored in the banknote handling assembly 210, the coin handling assembly 250, and the coin-roll storing assembly 280, and the like.

Next, a configuration of the storing cassette 300 that is used to exchange banknotes between the money depositing and dispensing machine 100 and the money change machine 200 is explained by using FIG. 12. As shown in FIG. 12, the storing cassette 300 has a casing 301 of a substantially cuboidal shape. The banknotes are stored in the casing 301 in a stacked manner. Moreover, the storing cassette 300 can be detachably mounted in the cassette mounting unit 126 of the money depositing and dispensing machine 100 and in the cassette mounting unit 226 of the money change machine 200. An opening 302 is formed on the side surface of the casing 301 of the storing cassette 300. When the storing cassette 300 is mounted in the cassette mounting unit 126 of the money depositing and dispensing machine 100 or the cassette mounting unit 226 of the money change machine 200, a banknote can be sent in the storing cassette 300 via the opening 302 from the transporting unit 130 arranged in the banknote handling assembly 110 of the money depositing and dispensing machine 100 or from the transporting unit 230 arranged in the banknote handling assembly 210 of the money change machine 200, and a banknote that has been stored in the storing cassette 300 can be fed to the transporting unit 130 of the banknote handling assembly 110 of the money depositing and dispensing machine 100 or to the transporting unit 230 of the banknote handling assembly 210 of the money change machine 200.

More particularly, a banknote feeding mechanism that feeds a banknote stored in the storing cassette 300 to the outside of the casing 301 from the opening 302 is arranged in the storing cassette 300. When the storing cassette 300 is mounted in the cassette mounting unit 126 of the money depositing and dispensing machine 100 or the cassette mounting unit 226 of the money change machine 200, a power is transmitted to the banknote feeding mechanism of the storing cassette 300 from the banknote handling assembly 110 of the money depositing and dispensing machine 100 or the banknote handling assembly 210 of the money change machine 200. In this manner, because a banknote stored in the storing cassette 300 cannot be fed to the outside of the storing cassette 300 in a state in which the storing cassette 300 has been removed from the cassette mounting unit 126 of the money depositing and dispensing machine 100 and from the cassette mounting unit 226 of the money change machine 200, the security of the stored banknote in the storing cassette 300 can be improved.

The recording medium 304, such as an IC chip, is arranged on a side surface of the casing 301 of the storing cassette 300. When the storing cassette 300 is mounted in the cassette mounting unit 126 of the money depositing and dispensing machine 100 or the cassette mounting unit 226 of the money change machine 200, various information as the change machine information of the money change machine 200 can be written in the recording medium 304 by the writing unit 128 arranged in the cassette mounting unit 126 of the money depositing and dispensing machine 100 and by the writing unit 228 arranged in the cassette mounting unit 226 of the money change machine 200, and various information as the change machine information of the money change machine 200 can be read from the recording medium 304 by the reading unit 129 arranged in the cassette mounting unit 126 of the money depositing and dispensing machine 100 and by the reading unit 229 arranged in the cassette mounting unit 226 of the money change machine 200.

An operation performed by the money management system 1 having the above-explained configuration is explained below. Specifically, an operation performed when collecting from the money change machine 200 the money as the sales proceeds accumulated in the shop 420 and storing the collected money in the money depositing and dispensing machine 100, and then, storing in the money change machine 200 the money as the change replenishment money that is dispensed from the money depositing and dispensing machine 100 is explained by using the flowchart shown in FIGS. 13 and 14.

In collecting from the money change machine 200 the money as the sales proceeds accumulated in the shop 420 and storing the collected money in the money depositing and dispensing machine 100, at first, the operator, such as the salesclerk, mounts the storing cassette 300 in the cassette mounting unit 226 arranged in the banknote handling assembly 210 of the money change machine 200 (STEP1). Then, the banknotes as the sales proceeds accumulated in the shop 420 are stored in the storing cassette 300 (STEP2). Specifically, among the banknotes that have been stored in the banknote storing units 234, 236, 238, banknotes other than the banknotes to be left in the banknote storing units 234, 236, 238 as change (that is, the banknotes to be left as the change reserve money) are caused to be fed from the banknote storing units 234, 236, 238 to the transporting unit 230 by the banknote feeding mechanisms 235, 237, 239, and then, the banknotes are sent by the transporting unit 230 to the storing cassette 300 mounted in the cassette mounting unit 226. Moreover, when storing in the storing cassette 300 the banknotes as the sales proceeds accumulated in the shop 420, the writing unit 228 writes in the recording medium 304 various information including the information concerning the inventory amount of the money in the money change machine 200 and the information concerning the banknotes that have been stored in the storing cassette 300 as the change machine information of the money change machine 200 (STEP3). In doing so, in spite of the fact that only the banknotes can be stored in the storing cassette 300, the information concerning the inventory amounts of the banknotes for each denomination in the banknote handling assembly 210, the information concerning the inventory amounts of the coins for each denomination in the coin handling assembly 250, and the information concerning the inventory amounts of the rolls of coins for each denomination in the coin-roll storing assembly 280 are written in the recording medium 304 by the writing unit 228 as the change machine information of the money change machine 200. Moreover, a register identification number that identifies a register machine for which the money change machine 200 is installed is also written in the recording medium 304 by the writing unit 228 as the change machine information of the money change machine 200. Moreover, information relating to a state of the money change machine 200 is also written in the recording medium 304 by the writing unit 228 as the change machine information of the money change machine 200. Specifically, if an error occurs in the money change machine 200, error information such as a kind of the error that has occurred in the money change machine 200 is written in the recording medium 304 by the writing unit 228 as the change machine information of the money change machine 200. Then, the operator removes the storing cassette 300 from the cassette mounting unit 226 after the banknotes as the sales proceeds accumulated in the shop 420 have been stored in the storing cassette 300 (STEP4). Then, the operator carries the storing cassette 300 from the money change machine 200 arranged in the front area to the money depositing and dispensing machine 100 arranged in the backyard area (STEP5), and mounts the storing cassette 300 in the cassette mounting unit 126 of the banknote handling assembly 110 of the money depositing and dispensing machine 100 (STEP6).

After the storing cassette 300 has been mounted in the cassette mounting unit 126 of the banknote handling assembly 110 of the money depositing and dispensing machine 100, the reading unit 129 arranged in the cassette mounting unit 126 reads the information recorded in the recording medium 304 arranged on the storing cassette 300 as the change machine information of the money change machine 200 (STEP7). Specifically, various information including the information concerning the inventory amount of the money in the money change machine 200 and the information concerning the banknotes stored in the storing cassette 300 is read by the reading unit 129 as the change machine information of the money change machine 200, and the change machine information of the money change machine 200 read by the reading unit 129 is sent to the controlling unit 102 of the money depositing and dispensing machine 100. The inventory-amount managing unit 107 manages the inventory amounts (specifically, the inventory amount of the banknotes in the banknote handling assembly 210, the inventory amount of the coins in the coin handling assembly 250, and the inventory amount of the rolls of coins in the coin-roll storing assembly 280) of the money in the money change machine 200 based on the change machine information of the money change machine 200 read by the reading unit 129. In the state that the storing cassette 300 has been mounted in the cassette mounting unit 126 of the banknote handling assembly 110 of the money depositing and dispensing machine 100, the banknote is fed from the storing cassette 300 to the transporting unit 130 of the banknote handling assembly 110, then sent to the banknote storing units 134 and 136 and the collecting cassette 140 by the transporting unit 130, and stored in the banknote storing units 134 and 136 and the collecting cassette 140 (STEP8). When collecting the coins and the rolls of coins from the money change machine 200 as the money as the sales proceeds accumulated in the shop 420 and storing in the money depositing and dispensing machine 100, the operator puts the coins dispensed from the coin handling assembly 250 and the rolls of coins removed from the coin-roll storing assembly 280 in, for example, a storage case and the like, with his/her hands, and carries the storage case with the coins and the rolls of coins from the money change machine 200 to the money depositing and dispensing machine 100. Then, the operator removes the coins and the rolls of coins from the storage case and performs the acts of depositing them in the coin handling assembly 150, storing them in the coin-roll storing assembly 180 of the money depositing and dispensing machine 100, and the like. In this manner, the money collected from the money change machine 200 as the sales proceeds accumulated in the shop 420 is stored in the money depositing and dispensing machine 100.

As mentioned above, the information concerning the remaining setting number for each denomination of the money relating to the change reserve money of the money change machine 200 has been stored in the memory 106 of the money depositing and dispensing machine 100. The calculating unit 108 calculates the number of money for each denomination concerning the change replenishment money that is to be deposited in the money change machine 200, based on the inventory amount of the money in the money change machine 200 managed by the inventory-amount managing unit 107 and the above-mentioned information stored in the memory 106. Moreover, the information calculated by the calculating unit 108 about the number of money for each denomination concerning the change replenishment money is displayed on the operation and displaying unit 104. Accordingly, the operator can recognize the information about the number of money for each denomination concerning the change replenishment money by looking at the display screen of the operation and displaying unit 104. Moreover, the operation and displaying unit 104 displays a confirmation button. The confirmation button is operated when permitting dispensing of the money concerning the change replenishment money that is to be deposited in the money change machine 200 from the money depositing and dispensing machine 100. When the operator operates the confirmation button displayed on the operation and displaying unit 104, the money of the number for each denomination concerning the change replenishment money calculated by the calculating unit 108 is dispensed from the money depositing and dispensing machine 100. As another example, it is allowable to configure the money depositing and dispensing machine 100 so that the money of the number for each denomination concerning the change replenishment money calculated by the calculating unit 108 is dispensed from the money depositing and dispensing machine 100 as soon as the storing cassette 300 is mounted in the money depositing and dispensing machine 100 and the information in the recording medium 304 is read by the reading unit 129.

Moreover, in the present embodiment, it is allowable to configure the money depositing and dispensing machine 100 so that the calculating unit 108 calculates the number of money for each denomination of loose coins concerning the change replenishment money that is to be deposited in the money change machine 200 based on the inventory amount of the coins in the coin handling assembly 250 of the money change machine 200 read from the recording medium 304 by the reading unit 129 and the information stored in the memory 106, and the rolls of coins concerning the change replenishment money are dispensed from the money depositing and dispensing machine 100 based on the calculation result obtained in the calculating unit 108. In this configuration, the packaging of the rolls of coins dispensed from the money depositing and dispensing machine 100 as the change replenishment money is unwrapped to obtain the loose coins, and the number of money for each denomination of coins concerning the change reserve money that is to be deposited in the money change machine 200 can be calculated by the calculating unit 108 with the presupposition that these loose coins will be deposited as the change replenishment money in the coin handling assembly 250 of the money change machine 200.

When a banknote is included in the money concerning the change replenishment money calculated by the calculating unit 108 that is to be deposited in the money change machine 200, the banknotes concerning the change replenishment money are stored in the storing cassette 300 mounted in the cassette mounting unit 126 (STEP9). Specifically, among the banknotes stored in the banknote storing units 134 and 136, the banknotes as the change replenishment money that is to be deposited in the money change machine 200 are fed by each of the banknote feeding mechanisms 135 and 137 from the banknote storing units 134 and 136 to the transporting unit 130, and these banknotes are then sent by the transporting unit 130 to the storing cassette 300 mounted in the cassette mounting unit 126. When a roll of coins is included in the money concerning the change replenishment money that is to be deposited in the money change machine 200 calculated by the calculating unit 108, the lock of the drawing unit 182 by the locking mechanism 184 is released, and the operator can remove the rolls of coins from the drawing unit 182 after pulling the drawing unit 182 out of the housing 101. As other example, when a roll of coins is included in the money concerning the change replenishment money that is to be deposited in the money change machine 200 calculated by the calculating unit 108, it is allowable to configure so that the drawing unit 182 automatically comes out of the housing 101. As mentioned above, because the weight scale 186 that measures the weight of the rolls of coins stored in each of the storing areas 180*a* to 180*f* of the drawing unit 182 is arranged in the coin-roll storing assembly 180, the number of rolls of coins for each denomination removed from the drawing unit 182 can be detected based on the weight of the roll of coins measured by the weight scale 186. When a loose coin is included in the money concerning the change replenishment money that is to be deposited in the money change machine 200 calculated by the calculating unit 108, loose coins are dispensed from the coin handling assembly 150.

When dispensing from the money depositing and dispensing machine 100 money concerning the change replenishment money that is to be deposited in the money change machine 200, the writing unit 128 writes various information including the information concerning the money of the change replenishment money (specifically, information concerning the number of banknotes for each denomination, the number of coins for each denomination, and the number of rolls of coins for each denomination as the change replenishment money) in the recording medium 304 (STEP10). In doing so, in spite of the fact that only the banknotes can be stored in the storing cassette 300, the information relating to information concerning the number of banknotes for each denomination, the number of coins for each denomination, and the number of rolls of coins for each denomination as the change replenishment money is written in the recording medium 304 by the writing unit 228. If an abnormality such as jamming of a banknote or a coin occurs in the banknote handling assembly 110 and the coin handling assembly 150 when dispensing money concerning the change replenishment money that is to be deposited in the money change machine 200 from the money depositing and dispensing machine 100, information concerning the number of money for each denomination that could not be dispensed from the banknote handling assembly 110 and the coin handling assembly 150 is written in the recording medium 304 by the writing unit 128. In such a case, the banknotes as the change replenishment money that could not be stored in the storing cassette 300 from the money depositing and dispensing machine 100 in which an abnormality has occurred can be stored in the storing cassette 300 from another money depositing and dispensing machine 100 by inserting the storing cassette 300 in the another money depositing and dispensing machine 100.

When the banknote as the change replenishment money that is to be deposited in the money change machine 200 is stored in the storing cassette 300, the operator removes the storing cassette 300 from the cassette mounting unit 126 (STEP11) of the money depositing and dispensing machine 100. Subsequently, the operator carries the storing cassette 300 from the money depositing and dispensing machine 100 arranged in the backyard area to the money change machine 200 arranged in the front area (STEP12) and mounts the storing cassette 300 in the cassette mounting unit 226 of the banknote handling assembly 210 of the money change machine 200 (STEP13).

When the storing cassette 300 is mounted in the cassette mounting unit 226 of the banknote handling assembly 210 of the money change machine 200, information that has been recorded in the recording medium 304 arranged on the storing cassette 300 is read by the reading unit 229 arranged in the cassette mounting unit 226 (STEP14). Specifically, various information including the information of the money concerning the change replenishment money that is to be deposited in the money change machine 200 is read by the reading unit 229, and the information read by the reading unit 229 is sent to the host controlling unit 202 of the money change machine 200. Moreover, the information related to the money including coins, banknotes, and rolls of coins that have been dispensed from the money depositing and dispensing machine 100 is displayed on the operation and displaying unit 204 of the money change machine 200 based on the information read by the reading unit 229. Accordingly, the operator can recognize the information about the money including the coins, the banknotes, and the rolls of coins that have been dispensed from the money depositing and dispensing machine 100 by looking the information displayed on the operation and displaying unit 204. Moreover, the dispensing information managing unit 206 manages the information related to the money including the coins, the banknotes, and the rolls of coins that have been dispensed from the money depositing and dispensing machine 100 based on the information read by the reading unit 229.

In the state that the storing cassette 300 has been mounted in the cassette mounting unit 226 of the banknote handling assembly 210 of the money change machine 200, the banknote is fed from the storing cassette 300 to the transporting unit 230 of the banknote handling assembly 210, and then stored by the transporting unit 230 in each of the banknote storing units 234, 236, 238 as the change reserve money (STEP15).

When causing the money depositing and dispensing machine 100 to dispense coins and rolls of coins as the money that is to be replenished in the money change machine 200 with as change reserve money and causing the money change machine 200 to store the same therein, the operator puts the coins dispensed from the coin handling assembly 150 and the rolls of coins removed from the coin-roll storing assembly 180 in, for example, a storage case and the like, with his/her hands, and carries the storage case with the coins and the rolls of coins from the money depositing and dispensing machine 100 to the money change machine 200. Then, the operator removes the coins and the rolls of coins from the storage case and performs the acts of depositing them in the coin handling assembly 250, storing them in the coin-roll storing assembly 280 of the money change machine 200, and the like. When the storing cassette 300 has been mounted in the cassette mounting unit 226 of the banknote handling assembly 210 of the money change machine 200 and the information recorded in the recording medium 304 arranged on the storing cassette 300 is read by the reading unit 229 arranged in the cassette mounting unit 226, and if information that indicates that at least one roll of coins is included in the money that has been dispensed from the money depositing and dispensing machine 100 is read from the recording medium 304 by the reading unit 229, the lock of the drawer 282 by the locking mechanism 286 is released and the operator can put roll of coins in the drawer 282 after pulling the drawer 282 out of the housing 281. As other example, if information that indicates that at least one roll of coins is included in the money that has been dispensed from the money depositing and dispensing machine 100 is read from the recording medium 304 by the reading unit 229, it is allowable to configure so that the drawer 282 automatically comes out of the housing 281. Moreover, the detecting unit 284 detects the number of rolls of coins for each denomination as the change replenishment money stored in the drawer 282. In this manner, the money that is to be replenished in the money change machine 200 as the change reserve money is dispensed from the money depositing and dispensing machine 100 and stored in the money change machine 200.

Moreover, the comparing unit 205 compares the number of money for each denomination concerning the change replenishment money deposited in the money change machine 200 and the number of money for each denomination concerning the change replenishment money obtained from information read by the reading unit 229 from the recording medium 304. When the both the numbers of money for each denomination do not match, it is determined that all the money dispensed from the money depositing and dispensing machine 100 has not been deposited in the money change machine 200. In such a situation, a warning message is displayed on the operation and displaying unit 204 arranged in the money change machine 200 or on the displaying unit 293 of the POS register 290.

Moreover, after the money as the change replenishment money that has been dispensed from the money depositing and dispensing machine 100 is stored in the money change machine 200, the determining unit 209 arranged in this money change machine 200 determines whether the number of rolls of coins for each denomination deposited in the drawer 282 and detected by the detecting unit 284 and the number of rolls of coins for each denomination dispensed from the money depositing and dispensing machine 100 and read by the reading unit 229 from the recording medium 304 match with each other. When the two numbers do not match, it is determined that all the rolls of coins removed by the operator from the coin-roll storing assembly 180 of the money depositing and dispensing machine 100 has not been stored in the coin-roll storing assembly 280 of the money change machine 200. In such a situation, a warning message is displayed on the operation and displaying unit 204 arranged in the money change machine 200 or on the displaying unit 293 of the POS register 290. Moreover, it is allowable to configure so that, when the two numbers do not match, the locking mechanism 286 does not lock the drawer 282 even if the drawer 282 is deposited in the housing 281. When the determining unit 209 of the money change machine 200 determines that the number of rolls of coins for each denomination deposited in the drawer 282 and detected by the detecting unit 284 and the number of rolls of coins for each denomination dispensed from the money depositing and dispensing machine 100 and read by the reading unit 229 do not match with each other, it is allowable to configure so that whether the loose coins equal to the number of rolls of coins obtained by deducting the number of rolls of coins for each denomination deposited in the drawer 282 and detected by the detecting unit 284 from the number of rolls of coins for each denomination dispensed from the money depositing and dispensing machine 100 and read by the reading unit 229 have been deposited in the coin handling assembly 250 of the money change machine 200 is determined based on a count result obtained by the recognition unit 256. In this case, even if the operator unpacks the package of the roll of coins that has been dispensed from the money depositing and dispensing machine 100 (specifically, the operator tears off the wrapping paper of the roll of coins) to prepare the loose coin and deposits those loose coins in the coin handling assembly 250 of the money change machine 200, it can be detected whether all the rolls of coins as the change replenishment money dispensed from the money depositing and dispensing machine 100 have been stored by the operator in the money change machine 200 in the form of the loose coins or the rolls of coins.

Subsequently, in the state that the storing cassette 300 has been mounted in the money change machine 200, when the money as the sales proceeds accumulated in the shop 420 is deposited in the money change machine 200 (STEP16), various information including the information concerning the inventory amount of the money in the money change machine 200 is written by the writing unit 228 in the recording medium 304 as the change machine information of the money change machine 200 (STEP17) in the money change machine 200. Then, the operator removes the storing cassette 300 from the cassette mounting unit 226 (STEP18) and transports the removed storing cassette 300 from the money change machine 200 that is arranged in the front area to the money depositing and dispensing machine 100 arranged in the backyard area (STEP19). When the operator mounts the storing cassette 300 in the cassette mounting unit 126 of the banknote handling assembly 110 of the money depositing and dispensing machine 100 (STEP20), in the money depositing and dispensing machine 100, information recorded in the recording medium 304 that is arranged in the storing cassette 300 is read by the reading unit 129 that is arranged in the cassette mounting unit 126 (STEP21). Then, the sales proceeds managing unit 109 can manage the information about the money concerning the sales proceeds deposited in the money change machine 200 during the time from a time point at which the storing cassette 300 is mounted in the money change machine 200 at the step STEP13 until a time point at which the storing cassette 300 is removed from the money change machine 200 at the step STEP18, based on the information concerning the inventory amount in the money change machine 200 read by the reading unit 129 from the recording medium 304 at each of the steps STEP7 and STEP21 and the information concerning the change replenishment money written in the recording medium 304 by the writing unit 128 at the step STEP10 (STEP22). Specifically, as shown in FIG. 15, by subtracting each of the number of money for each denomination concerning the change replenishment money written by the writing unit 128 in the recording medium 304 at the step STEP10 and the number of money for each denomination concerning the inventory amount in the money change machine 200 read from the recording medium 304 the first time in the step STEP7 from the number of money for each denomination concerning the inventory amount in the money change machine 200 read from the recording medium 304 the second time at the step STEP21, the number of money for each denomination concerning the sales proceeds deposited in the money change machine 200 can be calculated.

In the money depositing and dispensing machine 100 (a money handling apparatus) and the money handling method implemented on this money depositing and dispensing machine 100 of the present embodiment having the above-explained configuration, the money depositing and dispensing machine 100 includes the reading unit 129 that reads the change machine information that is information recorded in the recording medium 304 about the money change machine 200 arranged separately from the money depositing and dispensing machine 100, a dispensing unit (specifically, each of the banknote feeding mechanisms 135 and 137 and the transporting unit 130 that dispenses the banknotes in the banknote handling assembly 110, each of the storing and feeding unit 160 and the dispensing money transporting unit 162 that dispenses the coins in the coin handling assembly 150, the locking mechanism 184 that dispenses the rolls of coins in the coin-roll storing assembly 180, and the like) that dispenses money, and the controlling unit 102 that controls the dispensing unit to cause the dispensing unit to dispense the money that is to be replenished in the money change machine 200 based on the change machine information read by the reading unit 129. In this manner, in the present embodiment, by reading by the reading unit 129 the change machine information that is information about the money change machine 200 recorded in the recording medium 304 and dispensing the money which is to be replenished in the money change machine 200 based on the change machine information read by the reading unit 129, because the salesclerk is not required to make a manual input of the breakdown of the money that is to be replenished, the workload on the salesclerk is reduced, and an input mistake can be prevented.

Moreover, according to the money depositing and dispensing machine 100, the dispensing unit is adapted to dispense money (specifically a banknote) to the storing cassette 300 mounted in the money depositing and dispensing machine 100, but the money depositing and dispensing machine 100 by the present embodiment is not limited to such an embodiment. Alternatively, a money dispensing outlet (specifically, a coin outlet of the coin dispensing unit 166 or the banknote outlet 122*a* of the banknote dispensing unit 122) for ejecting the money from the inside of the housing 101 of the money depositing and dispensing machine 100 to the outside thereof can be provided, and the dispensing unit can be caused to dispense the money to the outside of the housing 101 through this money dispensing outlet.

The money management system 1, and the money depositing and dispensing machine 100 and the money change machine 200 arranged in the money management system 1 according to the present embodiment are not limited to those explained above and can be modified as desired.

For example, in the money change machine 200, when storing in the storing cassette 300 the banknotes as the sales proceeds accumulated in the shop 420, the writing unit 228 can be configured to write, instead of writing the information concerning the inventory amount of the money in the money change machine 200, information concerning the number of money for each denomination falling short as the change reserve money in the money change machine 200 in the recording medium 304 that is arranged in the storing cassette 300 as the change machine information of the money change machine 200. In this case, when the banknotes as the sales proceeds accumulated in the shop 420 are stored in the storing cassette 300, after the operator removes the storing cassette 300 from the cassette mounting unit 226 and mounts the storing cassette 300 in the cassette mounting unit 126 of the banknote handling assembly 110 of the money depositing and dispensing machine 100, the information (specifically, the information concerning the number of money for each denomination falling short as the change reserve money in the money change machine 200) recorded in the recording medium 304 arranged on the storing cassette 300 is read by the reading unit 129 arranged in the cassette mounting unit 126. Moreover, in the money management system 1 according to such a variation, the money depositing and dispensing machine 100 includes the change replenishment money managing unit 107*a* that manages the number of money for each denomination concerning the change replenishment money that is to be deposited in the money change machine 200 based on the information read by the reading unit 129. Then, after the banknotes as the sales proceeds that have been stored in the storing cassette 300 are stored in the banknote handling assembly 110, the information about the number of money for each denomination concerning the change replenishment money that is managed by the change replenishment money managing unit 107*a* and that is to be deposited in the money change machine 200 is displayed. Accordingly, the operator can recognize the information about the number of money for each denomination concerning the change replenishment money that is to be deposited in the money change machine 200 by looking at the display screen of the operation and displaying unit 104. Moreover, the confirmation button that is operated when permitting dispensing of the money concerning the change replenishment money that is to be deposited in the money change machine 200 from the money depositing and dispensing machine 100 is displayed on the operation and displaying unit 104. When the operator operates the confirmation button displayed on the operation and displaying unit 104, the money of the number for each denomination concerning the change replenishment money managed by the change replenishment money managing unit 107*a* is dispensed from the money depositing and dispensing machine 100. As another example, it is allowable to configure the money depositing and dispensing machine 100 so that the money of the number for each denomination concerning the change replenishment money managed by the change replenishment money managing unit 107*a* is dispensed from the money depositing and dispensing machine 100 as soon as the storing cassette 300 is mounted in the money depositing and dispensing machine 100 and the information in the recording medium 304 is read by the reading unit 129.

When a banknote is included in the money concerning the change replenishment money that is to be deposited in the money change machine 200 and managed by the change replenishment money managing unit 107*a*, the banknotes concerning the change replenishment money are stored in the storing cassette 300 mounted in the cassette mounting unit 126. When a roll of coins is included in the money concerning the change replenishment money that is to be deposited in the money change machine 200 and managed by the change replenishment money managing unit 107*a*, the lock of the drawing unit 182 by the locking mechanism 184 is released, and the operator can remove the rolls of coins from the drawing unit 182 after pulling the drawing unit 182 out of the housing 101. As other example, when a roll of coins is included in the money concerning the change replenishment money that is to be deposited in the money change machine 200 and managed by the change replenishment money managing unit 107*a*, it is allowable to configure so that the drawing unit 182 automatically comes out of the housing 101. When a loose coin is included in the money concerning the change replenishment money that is to be deposited in the money change machine 200 and managed by the change replenishment money managing unit 107*a*, loose coins are dispensed from the coin handling assembly 150.

In the money management system 1 according to another variation, various information such as the information concerning the inventory amount of the money in the money depositing and dispensing machine 100 and the money change machine 200, the information concerning the banknotes that have been stored in the storing cassette 300, and the like can be written in the ID card carried by the operator, such as the salesclerk, instead of written in the recording medium 304 arranged on the storing cassette 300. In the money management system 1 according to such a variation, when collecting the money as the sales proceeds from the money change machine 200, various information including the information concerning the inventory amount of the money in the money change machine 200 and the information concerning the banknotes that have been stored in the storing cassette 300 is written in the ID card carried by the operator when the operator inserts the ID card in the card reader 296 of the POS register 290. Moreover, when the money as the sales proceeds collected from the money change machine 200 is to be deposited into the money depositing and dispensing machine 100, various information including the information concerning the inventory amount of the money in the money change machine 200 and the information concerning the banknotes that have been stored in the storing cassette 300 recorded in the ID card is read when the operator inserts the ID card in a not-shown card reader arranged in the money depositing and dispensing machine 100, and the read information is sent to the controlling unit 102. Moreover, when the money as the change replenishment money that is to be deposited in the money change machine 200 is to be dispensed from the money depositing and dispensing machine 100, various information including the information concerning the money as the change replenishment money dispensed from the money depositing and dispensing machine 100 is written in the ID card when the operator inserts the ID card in a not-shown card reader arranged in the money depositing and dispensing machine 100. Moreover, when the money as the change replenishment money dispensed from the money depositing and dispensing machine 100 is to be deposited in the money change machine 200, various information including the information concerning the money as the change replenishment money recorded in the ID card is read when the operator inserts the ID card in the card reader 296 of the POS register 290, and the read information is sent from the POS controlling unit 291 of the POS register 290 to the host controlling unit 202 of the money change machine 200. In this manner, in the money management system 1 according to the above variation, various information can be exchanged between the money depositing and dispensing machine 100 and the money change machine 200 even if the recording medium 304 arranged on the storing cassette 300 is not used.

Moreover, in the money depositing and dispensing machine 100 of the money management system 1 according to yet another variation, the storing cassette 300 that is mounted in the cassette mounting unit 126 can be used as a banknote storing unit for recycling. That is, because the storing cassette 300 mounted in the cassette mounting unit 126 allows storing of the banknote inside the housing 101 and feeding of the banknotes that have been stored therein inside the housing 101, the storing cassette 300 functions like the banknote storing units 134 and 136. Moreover, when using the storing cassette 300 mounted in the cassette mounting unit 126 as the banknote storing unit for recycling, like the banknote storing units 134 and 136, a configuration can be adopted in which it is possible to assign the denomination of the banknotes to be stored in the storing cassette 300.

Moreover, in the money management system 1 according to yet another variation, when collecting the money as the sales proceeds accumulated in the shop 420 from the money change machine 200, it is allowable to configure so that the information concerning the money as the sales proceeds collected from the money change machine 200 is written by the writing unit 228 in the recording medium 304 arranged on the storing cassette 300 mounted in the cassette mounting unit 226. In this case, when the banknotes as the sales proceeds accumulated in the shop 420 are stored in the storing cassette 300, after the operator removes the storing cassette 300 from the cassette mounting unit 226 and mounts the storing cassette 300 in the cassette mounting unit 126 of the banknote handling assembly 110 of the money depositing and dispensing machine 100, the information (specifically, the information concerning the money as the sales proceeds collected from the money change machine 200) recorded in the recording medium 304 arranged on the storing cassette 300 is read by the reading unit 129 arranged in the cassette mounting unit 126. Moreover, the information read by the reading unit 129 is sent to the controlling unit 102. In the money depositing and dispensing machine 100, assuming that the information concerning the money as the sales proceeds collected from the money change machine 200 and read by the reading unit 129 is correct, the information concerning the collected money as the sales proceeds from the money change machine 200 can be managed in the controlling unit 102 even if the banknotes and the coins deposited in the banknote handling assembly 110 and the coin handling assembly 150 are not counted. As an alternative configuration, the counting of the banknotes and the coins deposited in the banknote handling assembly 110 and the coin handling assembly 150 can be performed by the recognition units 132 and 156, and the result of the counting of the deposited money obtained by the recognition units 132 and 156 and the information read by the reading unit 129 concerning the money as the sales proceeds collected from the money change machine 200 can be compared by the controlling unit 102. In this case, when the two do not match, it is determined that all the money as the sales proceeds collected from the money change machine 200 has not been deposited in the money depositing and dispensing machine 100, and a warning message is displayed on the operation and displaying unit 104. In the money management system 1 according to such a variation, security can be improved as the banknotes as the sales proceeds collected from the money change machine 200 can be deposited in the money depositing and dispensing machine 100 without allowing the operator to touch the banknotes, and the information about money as the sales proceeds collected from the money change machine 200 can be surely managed by the money depositing and dispensing machine 100.

In the money management system 1 according to yet another variation, it is allowable to adopt a configuration in which a coin storing cassette that stores therein coins and feeds out the coins stored therein is detachably attached in each of the money depositing and dispensing machine 100 and the money change machine 200. In this case, because the coins can be exchanged between the money depositing and dispensing machine 100 and the money change machine 200 by using the coin storing cassette, security can be improved as the operator is not allowed to touch the coins as the sales proceeds collected from the money change machine 200 and the coins that are dispensed from the money depositing and dispensing machine 100 and that is to be replenished in the money change machine 200 as the change replenishment money. Moreover, the above-explained recording medium 304 can be arranged on such a coin storing cassette that stores therein the coins.

Moreover, as another example, in the money depositing and dispensing machine 100, it is allowable to adopt a configuration in which only the counting of the banknotes that are fed from the storing cassette 300 mounted in the cassette mounting unit 126 is performed without performing recognition of the banknotes. In this case, the number of banknote obtained as a result of the counting and the number of banknote stored in the recording medium 304 arranged on the storing cassette 300 are compared, and, when the two numbers do not match, the fact that the two numbers do not match is displayed on the operation and displaying unit 104 and the like.

In the money depositing and dispensing machine 100, it is allowable to adopt a configuration in which, if it is recognized by the recognition unit 132 that a banknote fed from the storing cassette 300 mounted in the cassette mounting unit 126 is not a normal banknote (that is, it is a reject banknote), such a banknote is sent to and is stored in the money reject unit 124 or the collecting cassette 140, and which banknote is not normal is determined based on the information stored in the recording medium 304 arranged on the storing cassette 300. Moreover, in this case, the information recorded in the recording medium 304 can be overwritten by the information about the banknote which is recognized to be not normal by the writing unit 128 based on the recognition result obtained by the recognition unit 132. Moreover, when manually inputting from the operation and displaying unit 104 and the like denominations and numbers of the banknotes that are recognized by the recognition unit 132 to be not normal, the number of times of the input needs to be performed can be reduced by reflecting the denominations and the numbers of the reject banknotes in manual input items.

What is claimed is:

1. A money handling apparatus that performs at least a money dispensing processing, comprising:

a reading unit that reads change machine information that is information stored in a recording medium about a money change machine provided separately from the money handling apparatus;

a dispensing unit that dispenses money; and a controlling unit that controls the dispensing unit to cause the dispensing unit to dispense money that is to be replenished in the money change machine based on the change machine information read by the reading unit, wherein the change machine information is an inventory amount of the money change machine including an inventory amount of a roll of coins.

2. The money handling apparatus as claimed in claim 1, further comprising a memory that stores therein a remaining setting number for each denomination of money in the money change machine, wherein number of money for each denomination that is to be dispensed by the dispensing unit is calculated by subtracting number of money for each denomination concerning the inventory amount of the money change machine read by the reading unit from the remaining setting number for each denomination of money stored in the memory.

3. The money handling apparatus as claimed in claim 1, further comprising a money dispensing outlet for ejecting money from inside to outside of the housing, wherein the dispensing unit dispenses money to the outside of the housing through the money dispensing outlet.

4. The money handling apparatus as claimed in claim 1, wherein a storing cassette that stores therein money and that feeds out money stored therein is detachably attached to the money handling apparatus, the recording medium is arranged in the storing cassette, and the reading unit reads the information stored in the recording medium arranged on the storing cassette when the storing cassette is attached to the money handling apparatus.

5. The money handling apparatus as claimed in claim 4, wherein the dispensing unit dispenses money into the storing cassette that has been attached to the money handling apparatus.

6. A money handling apparatus that performs at least a money dispensing processing, comprising:

a reading unit that reads change machine information that is information stored in a recording medium about a money change machine provided separately from the money handling apparatus;

a dispensing unit that dispenses money;

a controlling unit that controls the dispensing unit to cause the dispensing unit to dispense money that is to be replenished in the money change machine based on the change machine information read by the reading unit;

a coin-roll storing assembly that stores therein a roll of coins; and a locking mechanism that locks the coin-roll storing assembly inside a housing, wherein the controlling unit controls the locking mechanism to release the lock of the coin-roll storing assembly if a roll of coins is included in the money that is to be dispensed by the dispensing unit.

7. A money handling apparatus that performs at least a money dispensing processing, comprising a reading unit that reads change machine information that is information stored in a recording medium about a money change machine provided separately from the money handling apparatus;

a dispensing unit that dispenses money;

a controlling unit that controls the dispensing unit to cause the dispensing unit to dispense money that is to be replenished in the money change machine based on the change machine information read by the reading unit; and a writing unit that writes information in the recording medium, wherein the controlling unit controls the writing unit to cause the writing unit to write in the recording medium information concerning number of money for each denomination that could not be dispensed by the dispensing unit when an abnormality occurs while the dispensing unit is dispensing money.

* * * * *